US010507994B2

(12) United States Patent
Sendo

(10) Patent No.: US 10,507,994 B2
(45) Date of Patent: Dec. 17, 2019

(54) PAPER FEEDER

(71) Applicant: Konica Minolta, Inc., Tokyo (JP)

(72) Inventor: Hiroshi Sendo, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/786,963

(22) Filed: Oct. 18, 2017

(65) Prior Publication Data

US 2018/0118483 A1 May 3, 2018

(30) Foreign Application Priority Data

Nov. 1, 2016 (JP) ..... 2016-214164

(51) Int. Cl.

| | |
|---|---|
| ***B65H 3/14*** | (2006.01) |
| ***B65H 5/22*** | (2006.01) |
| ***B65H 7/02*** | (2006.01) |
| ***B65H 7/16*** | (2006.01) |

(52) U.S. Cl.

CPC ..... *B65H 3/14* (2013.01); *B65H 5/222* (2013.01); *B65H 7/02* (2013.01); *B65H 7/16* (2013.01); *B65H 2406/364* (2013.01); *B65H 2513/512* (2013.01); *B65H 2513/514* (2013.01)

(58) Field of Classification Search

CPC . B65H 3/14; B65H 5/222; B65H 3/08; B65H 3/0816; B65H 3/0833; B65H 3/0866; B65H 3/12; B65H 3/124; B65H 3/128; B65H 3/48

See application file for complete search history.

(56) References Cited

U.S. PATENT DOCUMENTS

| | | | | |
|---|---|---|---|---|
| 5,478,066 | A * | 12/1995 | Yoshida | B65H 3/128 271/104 |
| 8,444,138 | B2 * | 5/2013 | Taki | B65H 3/128 271/105 |
| 2011/0163492 | A1 * | 7/2011 | Taki | B65H 3/128 271/5 |
| 2014/0061999 | A1 * | 3/2014 | Okamoto | B65H 3/08 271/11 |
| 2018/0065821 | A1 * | 3/2018 | Masuda | B65H 3/0684 |

FOREIGN PATENT DOCUMENTS

JP 2016078975 A 5/2016

* cited by examiner

*Primary Examiner* — Thomas A Morrison
(74) *Attorney, Agent, or Firm* — Lucas & Mercanti, LLP

(57) ABSTRACT

A paper feeder for transporting paper sheets, includes: a head fan that blows air on the paper sheets; a suction fan that applies negative pressure to the paper sheets blown by the head fan; a switching member that changes the direction of the air from the head fan; a head shutter that blocks the flow of the air directed by the switching member; and a hardware processor that determines the blocking time of the airflow, wherein the switching member changes the air direction between a first direction for floating the paper sheets and a second direction toward the suction fan, and the hardware processor determines stop timing of the air blow in the second direction directed by the switching member as the start timing of clocking the blocking time of the airflow, based on the weight and the resistance to an external force of the paper sheets.

19 Claims, 18 Drawing Sheets

PAPER FEEDER

Japanese Patent Application No. 2016-214164 filed on Nov. 1, 2016, including description, claims, drawings, and abstract the entire disclosure is incorporated herein by reference in its entirety.

BACKGROUND

Technological Field

The present invention relates to a paper feeder.

Description of the Related Art

Recent image forming apparatuses such as copiers and printers include paper feeders. There are various paper feeders that blow air on the sides of stacked paper sheets for floating some paper sheets, blow air on the floating paper sheets for separating the paper sheets from each other before transporting the paper sheets one by one (See JP 2016-78975 A, for example).

A conventional paper feeder as disclosed in JP 2016-78975 A, however, cannot deal with various types of paper sheets since the volume of air from its fan is difficult to control minutely. For example, a pulse width modulation (PWM) fan suitable for paper sheets with a basis weight of 400 g/m$^2$ is too powerful for paper sheets with a basis weight of 40 g/m$^2$. If such a PWM fan is used for paper sheets with a basis weight of 40 g/m$^2$, the large volume of air may cause buckling and backward displacement of the paper sheets, which may lead to a paper jam.

To solve this problem, the above conventional paper feeder includes a multistage shutter to control the volume of air to blow on paper sheets. This causes another problem, that is, increase in the size and the cost of the paper feeder.

In other words, the conventional paper feeders as disclosed in JP 2016-78975 A need an expensive structures for controlling the volume of air to achieve appropriate conditions for various types of paper sheets.

In addition, the above conventional paper feeder with the multistage shutter controls the volume of air by simply opening and closing the shutter at the air outlet of the fan while the paper sheets are being transported one by one. When the transportation of a paper sheet is delayed for printing adjustment or post-processing, the paper feeder extends the length of time for blowing air on the floating paper sheets in the process for separating the paper sheets from each other. This may also cause a paper jam depending on the type of the paper sheets.

SUMMARY

The present invention has been made to solve the above problems, and an object of the present invention is to provide a paper feeder that achieves appropriate conditions for various types of paper sheets with a low-cost structure for controlling the volume of air.

To achieve the abovementioned object, according to an aspect of the present invention, a paper feeder for transporting paper sheets from a paper rest one by one, reflecting one aspect of the present invention comprises: a head fan that blows air on the paper sheets on or above the paper rest; a suction fan that applies negative pressure to some of the paper sheets blown by the head fan; a switching member that changes the direction of the air from the head fan; a head shutter that blocks the flow of the air directed by the switching member; and a hardware processor that determines the length of time for blocking the airflow by the head shutter, wherein the switching member changes the direction of the air from the head fan between a first direction for floating some of the paper sheets and a second direction toward the suction fan, and the hardware processor determines timing of stopping the air blow in the second direction directed by the switching member as the start timing of clocking the length of time for blocking the airflow, based on the weight of one of the paper sheets and the resistance of the paper sheet to an external force.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
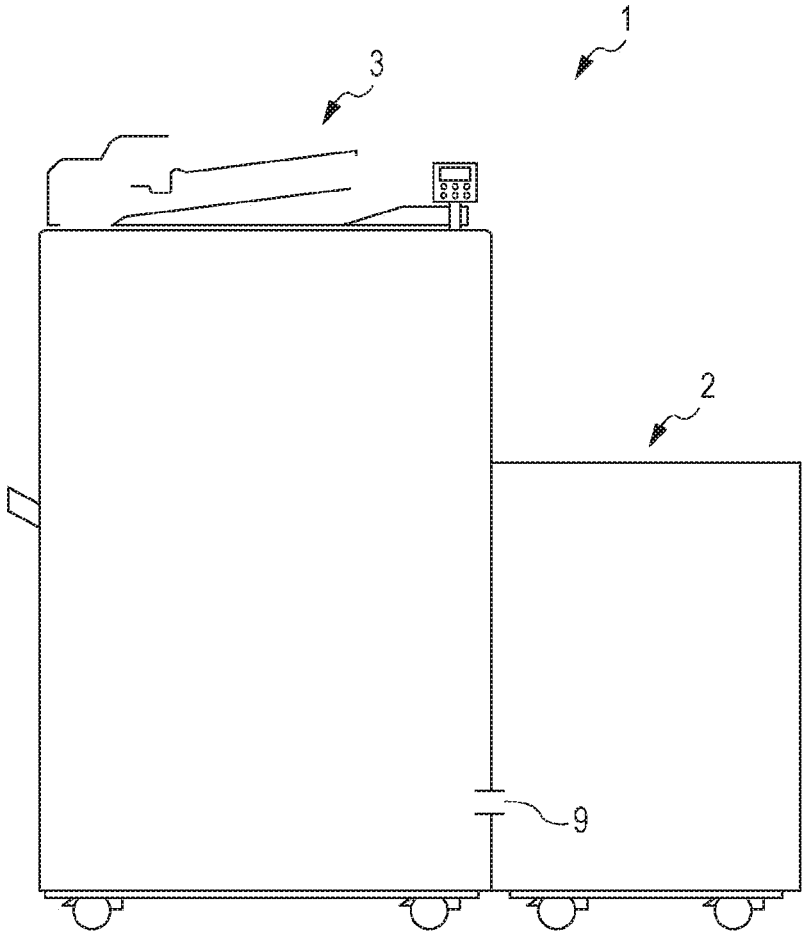
FIG. 1 shows an example overall structure of an image forming system according to a first embodiment of the present invention.

FIG. 1 shows an example overall structure of an image forming system 1 according to a first embodiment of the present invention. As show in FIG. 1, the image forming system 1 includes a paper feeding apparatus 2 and an image forming apparatus 3. The paper feeding apparatus 2 is connected to the image forming apparatus 3 via a communicating hole 9.

The paper feeding apparatus 2 feeds paper sheets P one by one. A paper sheet P from the paper feeding apparatus 2 is transported into the image forming apparatus 3 through the communicating hole 9. The image forming apparatus 3 performs various kinds of image processing on the paper sheet P and ejects the paper sheet P onto an outside paper tray.

Figure 2:
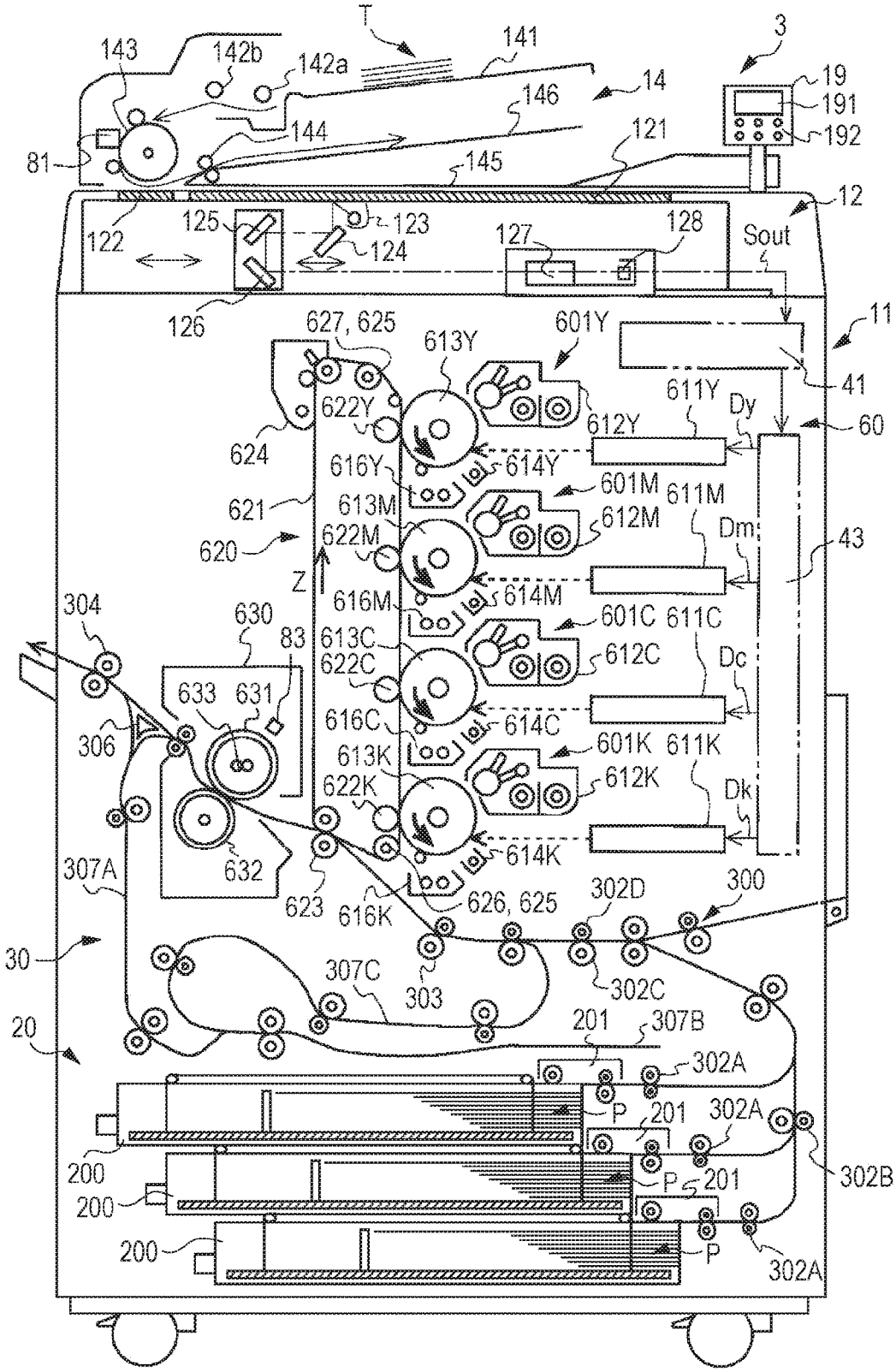
FIG. 2 shows an example structure of an image forming apparatus according to the first embodiment of the present invention.

FIG. 2 shows an example structure of the image forming apparatus 3 according to the first embodiment of the present invention. As shown in FIG. 2, the image forming apparatus 3 is a color copier, for example. The image forming apparatus 3 reads a color image on an original T to acquire the image data. The image forming apparatus 3 forms a multicolor image by superposing different color images based on the acquired image data. The image forming apparatus 3 is applicable to color printers or color facsimiles, or color multifunctional machines as well as color copiers.

The image forming apparatus 3 includes an image forming apparatus main body 11. The image forming apparatus 3 further includes a color image reader 12 and an automatic document feeder 14 on the image forming apparatus main body 11. The image forming apparatus main body 11 includes a controller 41, an image processing unit 43, an image forming station 60, a paper feeding unit 20, and a transporting unit 30. Further details will be described later The image reader 12 includes an operation panel 19. The operation panel 19 includes a display screen 191 and an operation section 192. The operation section 192 receives the input from a user and the display screen 191 displays the information on the input from the user.

The automatic document feeder 14 is disposed on the image reader 12. The automatic document feeder 14 automatically feeds one or more originals T to the image reader 12 in an automatic feeding mode. After the automatic feed of an original T by the automatic document feeder 14, the image reader 12 reads an image on the original T in the automatic feeding mode.

The automatic document feeder 14 includes an input tray 141, a roller 142*a*, a roller 142*b*, a roller 143, a roller 144, a turner 145, and an output tray 146. The input tray 141 holds one or more originals T. The rollers 142*a* and 142*b* are disposed downstream of the input tray 141. The roller 143 is disposed downstream of the rollers 142*a* and 142*b*. A positioning detection sensor 81 is disposed near the outer area of the roller 143.

In the automatic feeding mode, an original T on the input tray 141 is transported to the roller 143 to make a U-turn around the roller 143. The original T is preferably placed face up on the input tray 141 in the automatic feeding mode.

The original T is then transported by the roller 144 to be read by the image reader 12 before being ejected onto the output tray 146. Before ejecting the original T, the automatic document feeder 14 can transport the original T to the turner 145, which flips the original T, and then transport the original T to the image reader 12 again, which reads the other side of the original T this time, if necessary.

The positioning detection sensor 81 detects the original T. The positioning detection sensor 81 is a reflective photosensor, for example. When the positioning detection sensor 81 detects the original T, the positioning detection sensor 81 starts sending output signals to the controller 41. When the positioning detection sensor 81 finds the original T undetectable anymore, the positioning detection sensor 81 stops sending output signals to the controller 41. In other words, the positioning detection sensor 81 maintains a certain level of output signals while the original T is within the detection range of the positioning detection sensor 81.

The image reader 12 reads a color image on the original T. The image reader 12 includes a one-dimensional image sensor 128. The image reader 12 further includes a first glass platen 121, a second glass platen 122, a light source 123, mirrors 124 to 126, an image-forming optical element 127, and an optical driver (not shown).

The light source 123 irradiates the original T with light. The optical driver (not shown) moves the original T in the subscanning direction with respect to the image sensor 128 or moves the image sensor 128 in the subscanning direction with respect to the original T. The main scanning direction corresponds to the direction of the arrangement of the light receiving elements of the image sensor 128. The subscanning direction is orthogonal to the main scanning direction.

The original T is transported by the automatic document feeder 14 to the image reader 12, the optical system of which scans the image(s) on one side or both sides of the original T. The image sensor 128 thus reads the image(s) on one side or both sides of the original T. The image sensor 128 generates image-reading signals Sout in an RGB color system based on the read image data of the original T in a platen mode. In the platen mode, the image sensor 128 automatically reads the image(s) on the original T placed on the first glass platen 121 with the optical driver (not shown).

The image sensor 128 is a three-line-color charge-coupled device (CCD) image sensor. The image sensor 128 includes a plurality of arrays of light receiving elements in the main scanning direction. Specifically, the image sensor 128 includes individual read sensors for different colors: red (R), green (G), and blue (B). Each read sensor divides the pixels in different positions in the main scanning direction and in the subscanning direction orthogonal to the main scanning direction, and reads the optical information on the corresponding color (R, G, or B) simultaneously with the other read sensors. For example, when the original T makes a U-turn around the roller 143 in the automatic feeding mode, the image sensor 128 reads the surface of the original T and outputs image-reading signals Sout. The image-reading signals Sout are analog signals photoelectrically converted by the image sensor 128.

The image sensor 128 photoelectrically converts reflective light from the image on the original T to those signals. The image sensor 128 is connected to the image processing unit 43 via the controller 41. The image-reading signals Sout are thus sent to the image processing unit 43 via the controller 41. The image processing unit 43 performs various kinds of processing on the image-reading signals Sout.

The image processing unit 43 includes an arithmetic unit such as a CPU and an integrated circuit such as an application-specific integrated circuit (ASIC). The image processing unit 43 is a processor for performing various kinds of processing. For example, the image processing unit 43 performs analog processing, analog-to-digital conversion, shading compensation, image data compression, and scaling on the image-reading signals Sout.

The image processing unit 43 converts the analog image-reading signals Sout to digital image data (R, G, and B) including three color components of R, G, and B, and to image data (Dy, Dm, Dc, and Dk) including four color components of yellow (Y), magenta (M), cyan (C), and black (K). The image processing unit 43 then sends the image data (Dy, Dm, Dc, and Dk) to LED writing sections 611Y, 611M, 611C, and 611K in the image forming station 60.

The image forming station 60 adopts electrophotography. The image forming station 60 forms a color image for an intermediate transfer. In FIG. 2, for example, the image forming station 60 is of a vertical tandem type. The image forming station 60 includes image forming units 601Y, 601M, 601C, and 601K for respective colors, an intermediate transferring unit 620, and a fixing unit 630. The image forming station 60 forms a color image based on the image data (Dy, Dm, Dc, and Dk) from the image processing unit 43.

The image forming unit 601Y forms a color image of yellow (Y). The image forming unit 601Y includes a photoconductor drum 613Y, a charging section 614Y, an LED writing section 611Y, a developing section 612Y, and a cleaning section 616Y.

The photoconductor drum 613Y forms a toner image of Y. The charging section 614Y is disposed near the photoconductor drum 613Y and uniformly charges the surface of the photoconductor drum 613Y negatively by corona discharge. The LED writing section 611Y irradiates the photoconductor drum 613Y with light corresponding to the image of the Y color component. The developing section 612Y provides toner of the Y color component to the surface of the photoconductor drum 613Y having an electrostatic latent image to form a visible toner image corresponding to the electrostatic latent image. The cleaning section 616Y removes the residual toner from the surface of the photoconductor drum 613Y after a first transfer.

The other image forming units 601M, 601C, and 601K have the same structures and functions as those of the image forming unit 601Y except for the color of the image to form. The descriptions of the image forming units 601M, 601C, and 601K will thus be omitted. Note that an image forming unit 601 is a general indication for the image forming units 601Y, 601M, 601C, and 601K.

The intermediate transferring unit 620 includes an intermediate transferring belt 621, first transferring rollers 622Y, 622M, 622C, and 622K, a second transferring roller 623, and a belt cleaning device 624.

The intermediate transferring belt 621 is an endless belt. The endless intermediate transferring belt 621 is mounted on a plurality of rollers 625. The rollers 625 apply sufficient tension to the endless intermediate transferring belt 621 in a loop. At least one of the rollers 625 is a driving roller 626 and the other rollers 625 are driven rollers 627. The driving roller 626 is preferably disposed downstream of the first transferring roller 622K for the K color component in the moving direction of the belt. The rotation of the driving roller 626 moves the intermediate transferring belt 621 at a constant speed in the direction indicated by the arrow Z.

The first transferring rollers 622Y, 622M, 622C, and 622K are disposed inside the loop of the intermediate transferring belt 621. The first transferring rollers 622Y, 622M, 622C, and 622K face the photoconductor drums 613Y, 613M, 613C, and 613K, respectively. The first transferring rollers 622Y, 622M, 622C, and 622K press the intermediate transferring belt 621 against the photoconductor drums 613Y, 613M, 613C, and 613K, respectively. This arrangements form first nip areas between the intermediate transferring belt 621 and the photoconductor drums 613Y, 613M, 613C, and 613K. In the first nip areas, the toner images on the photoconductor drums 613Y, 613M, 613C, and 613K are transferred onto the intermediate transferring belt 621 one by one.

Note that a first transferring roller 622 is a general indication for the first transferring rollers 622Y, 622M, 622C, and 622K. In addition, a photoconductor drum 613 is a general indication for the photoconductor drums 613Y, 613M, 613C, and 613K.

The second transferring roller 623 is disposed outside the loop of the intermediate transferring belt 621. The second transferring roller 623 faces one of the rollers 625. This roller 625 facing the second transferring roller 623 is called a backup roller. The intermediate transferring belt 621 is pressed between the second transferring roller 623 and the backup roller, which forms a second nip area. In the second nip area, the toner image on the intermediate transferring belt 621 is transferred onto a paper sheet P.

In the transferring processes, the toner images on the respective photoconductor drums 613 are transferred onto the intermediate transferring belt 621 one by one in the respective first nip areas to form one toner image on the intermediate transferring belt 621 (a first transferring process). Specifically, the first transferring rollers 622 are biased while the intermediate transferring belt 621 is charged reversely from the toner on the photoconductor drums 613 in the areas on the back surface in contact with the first transferring rollers 622, so that the toner images are electrostatically transferred onto the intermediate transferring belt 621.

After the first transferring process for electrostatically transferring the toner images onto the intermediate transferring belt 621, the toner image on the intermediate transferring belt 621 is transferred onto a paper sheet P in the second nip area (a second transferring process). Specifically, the second transferring roller 623 is biased while the paper sheet P is charged reversely from the toner on the intermediate transferring belt 621 in the area on the back surface in contact with the second transferring roller 623, so that the toner image is electrostatically transferred onto the paper sheet P. The paper sheet P with the toner image is then transported to the fixing unit 630.

The belt cleaning device 624 includes a cleaning blade and is in contact with the surface of the intermediate transferring belt 621 to slide on the surface of the intermediate transferring belt 621. The belt cleaning device 624 removes the residual toner from the surface of the intermediate transferring belt 621 after the second transferring process.

The intermediate transferring unit 620 may be a belt-type second transferring unit, which adopts a second transferring belt (not shown) mounted on a plurality of supporting rollers including the second transferring roller 623 in a loop, instead of the second transferring roller 623.

The fixing unit 630 includes a heating roller 631, a pressing roller 632, a heater 633, and a temperature sensor 83, and fixes the toner image on the paper sheet P after the transferring processes in the image forming station 60.

The heater 633 is disposed inside the heating roller 631 and intermittently heats the heating roller 631. The pressing roller 632 faces the heating roller 631 and presses the heating roller 631. The temperature sensor 83 is disposed near the heating roller 631 and detects the heat of the heating roller 631. The temperature sensor 83 has a sampling period of 100 ms, for example.

Based on the detected results of the temperature sensor 83, the heater 633 heats the heating roller 631. The fixing unit 630 has a nip area between the heating roller 631 and the pressing roller 632, where the pressing roller 632 presses the heating roller 631.

The fixing unit 630 fixes the toner image on the paper sheet P, which has been transferred in the image forming station 60, by pressure provided by the pressing roller 632 and heat provided by the heating roller 631. The fixing unit 630 completes the printing of the image on the paper sheet P in this way. The paper sheet P with the printed image is then ejected to the outside of the apparatus by an ejecting roller 304.

The paper feeding unit 20 includes a paper cassette 200 and a feeding roller 201. The paper cassette 200 stores paper sheets P. The feeding roller 201 takes a paper sheet P in the paper cassette 200 and feeds the paper sheet P into the transporting unit 30.

The transporting unit 30 includes a transporting path 300. The transporting unit 30 transports the paper sheet P along the transporting path 300. The transporting path 300 includes a feeding roller 302A, transporting rollers 302B, 302C, 302D, and 303.

The paper sheet P from the paper feeding unit 20 is transported through the transporting path 300 to the image forming station 60. When both sides of the paper sheet P are subjected to image formation, the paper sheet P is first subjected to image formation on the front side along the transporting path 300 and then transported into a circulating path 307A via a branch 306. After the circulating path 307A, the paper sheet P is transported into a reverse transporting path 307B and then into a reentry transporting path 307C.

The controller 41 includes a CPU, a ROM, a RAM, and an I/O interface, all of which are not shown. In the controller 41, the CPU reads programs necessary for various kinds of processing from the ROM or other memory (not shown) and expands the programs in the RAM to use the programs. The controller 41 controls individual parts of the image forming apparatus 3 based on the programs. The controller 41 functions as a processor for performing various kinds of processing.

The image processing unit 43 optimizes the image to be formed by the image forming station 60 based on an amount of correction in a patch. The optimization by the image processing unit 43 includes positioning of the image(s) on the front and/or back side(s) of a paper sheet P, density adjustment, and hue adjustment.

The image processing unit 43 corrects the color, position, or magnification of the image to be formed on a paper sheet P based on the information on a patch in the paper sheet P read by an image reader (not shown). Specifically, the image processing unit 43 corrects the image to be formed on a paper sheet P based on the color values of a patch. The image processing unit 43 sends instructions as to image formation based on the correction results to the image forming station 60 before the image forming station 60 performs image formation on a new paper sheet P.

Figure 3:
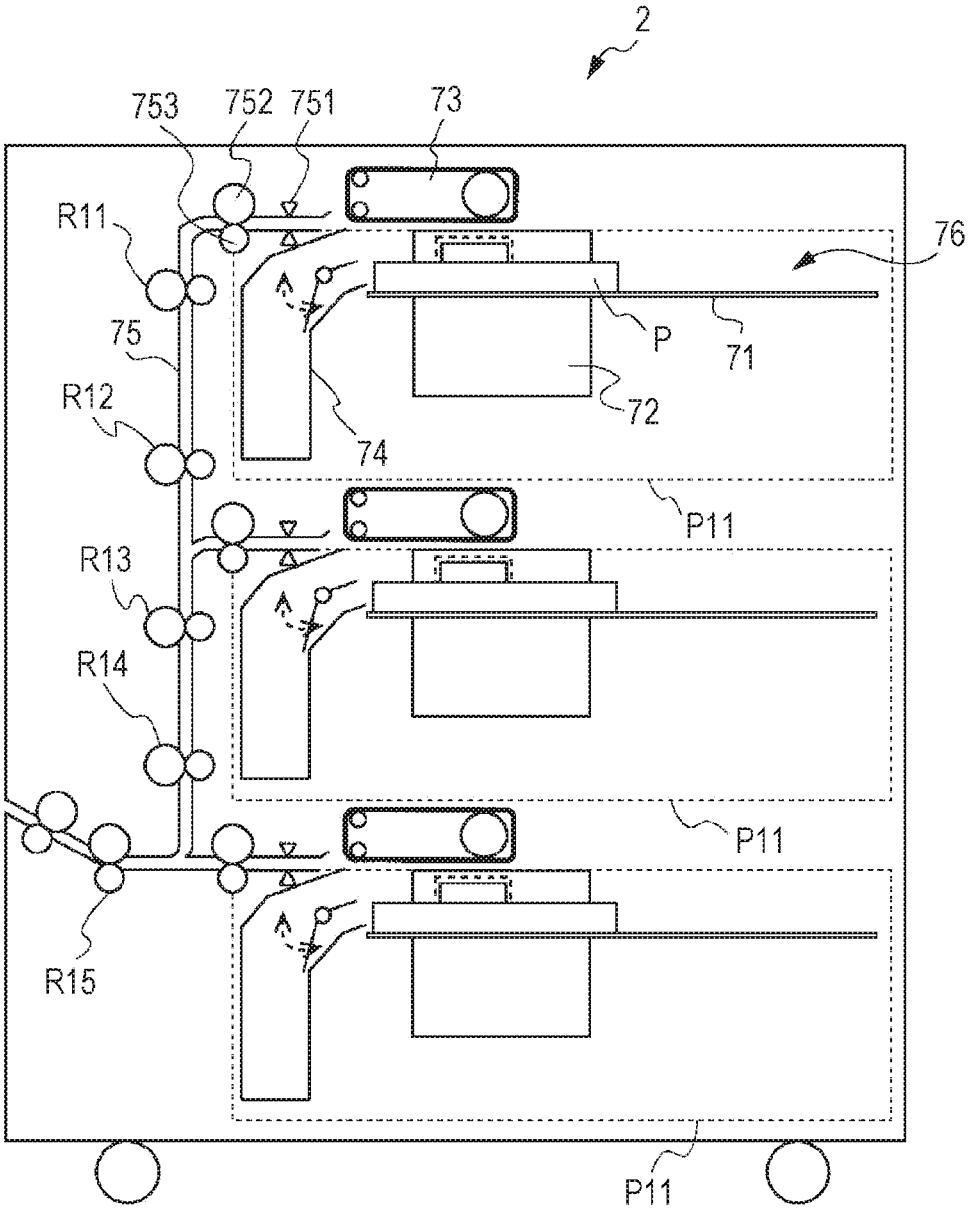
FIG. 3 shows an example structure of a paper feeding apparatus according to the first embodiment of the present invention.

FIG. 3 shows an example structure of the paper feeding apparatus 2 according to the first embodiment of the present invention. As shown in FIG. 3, the paper feeding apparatus 2 includes three paper compartments P11 each having a paper holder 76, for example. The paper compartments P11 are arranged vertically. The paper feeding apparatus 2 includes a drawing conveyor 73 above each paper holder 76. The paper feeding apparatus 2 includes a pair of side guides 72 along two opposite longitudinal sides of each paper holder 76.

The side guides 72 blow side air A3 on the paper sheets P on a paper rest 71 in the width direction of the paper sheets P while preventing the paper sheets P from moving in the width direction. Further details will be described later. The side guides 72 help the drawing conveyor 73 to draw some of the paper sheets P also blown by an air blower 74.

The air blower 74 is disposed near the head edges of the paper sheets P on the paper rest 71. First, the air blower 74 blows floating air A1 on the paper sheets P for floating some paper sheets P. Next, the air blower 74 blows separating air A2 on the floating paper sheets P for separating the uppermost paper sheet P from the lower paper sheets P. The air blower 74 preferably blows separating air A2 especially when more than one paper sheets P are drawn to the drawing conveyor 73.

The drawing conveyor 73 holds one paper sheet P separated from the other paper sheets P on the paper rest 71. The drawing conveyor 73 transports the one separate paper sheet P into a transporting unit 75. Further details will be described later.

The transporting unit 75 includes a paper sheet detection sensor 751, a transporting roller 752, a driven roller 753, and transporting rollers R11 to R15. The paper sheet detection sensor 751 is a photosensor having a light receiving element and a light emitting element, for example. The paper sheet P from the drawing conveyor 73 is detected by the paper sheet detection sensor 751. The paper sheet P is then guided by a guide member (not shown) in the right direction between the transporting roller 752 and the driven roller 753, transported downward by the transporting rollers R11 to R14 in the vertical direction, and directed to the transporting roller R15. The transporting roller R15 functions as a resistance roller for feeding the paper sheet P through the communicating hole 9 shown in FIG. 2 into the image forming apparatus 3 at the right timing for the image forming processes taken by the image forming apparatus 3.

Figure 4:
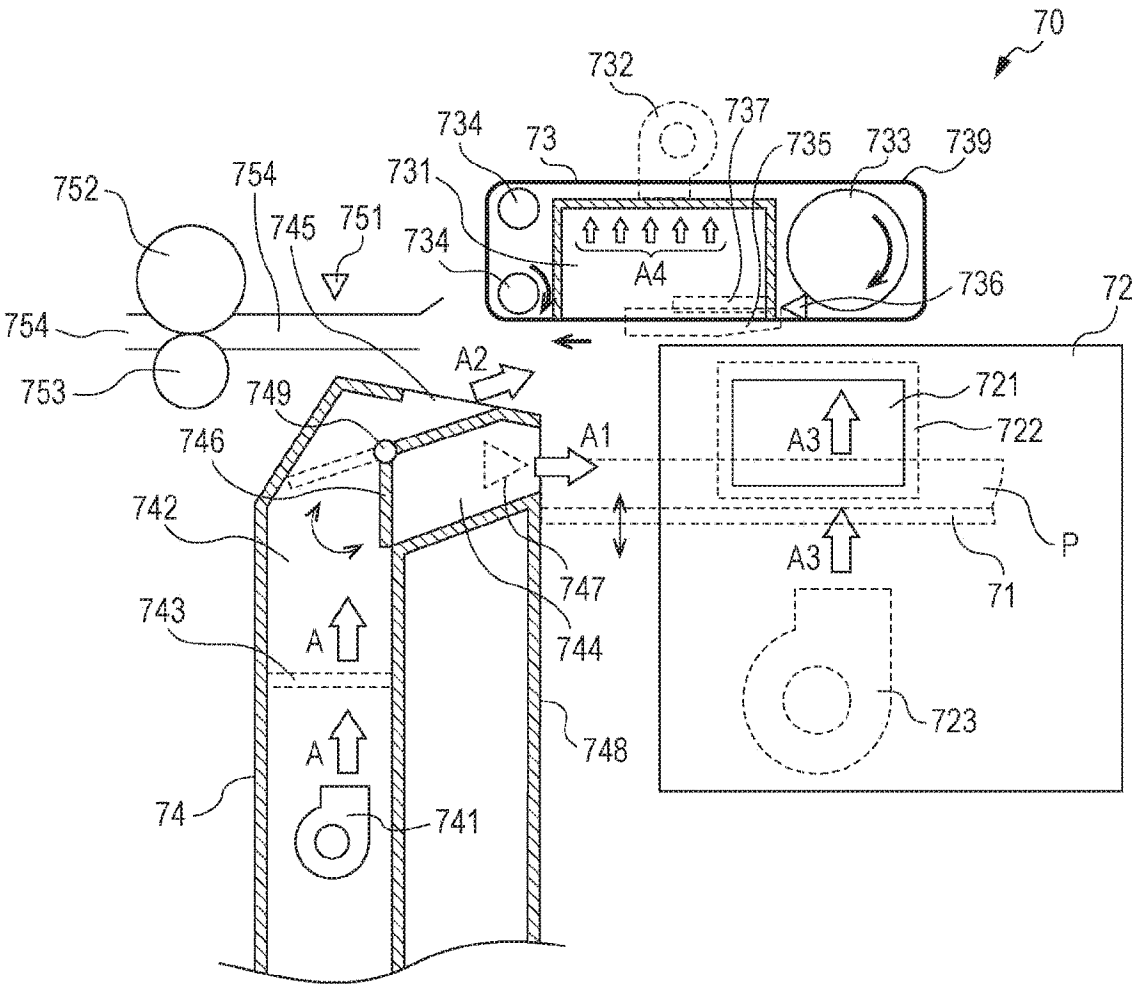
FIG. 4 is a side view of an example structure of a paper feeder according to the first embodiment of the present invention.
Figure 5:
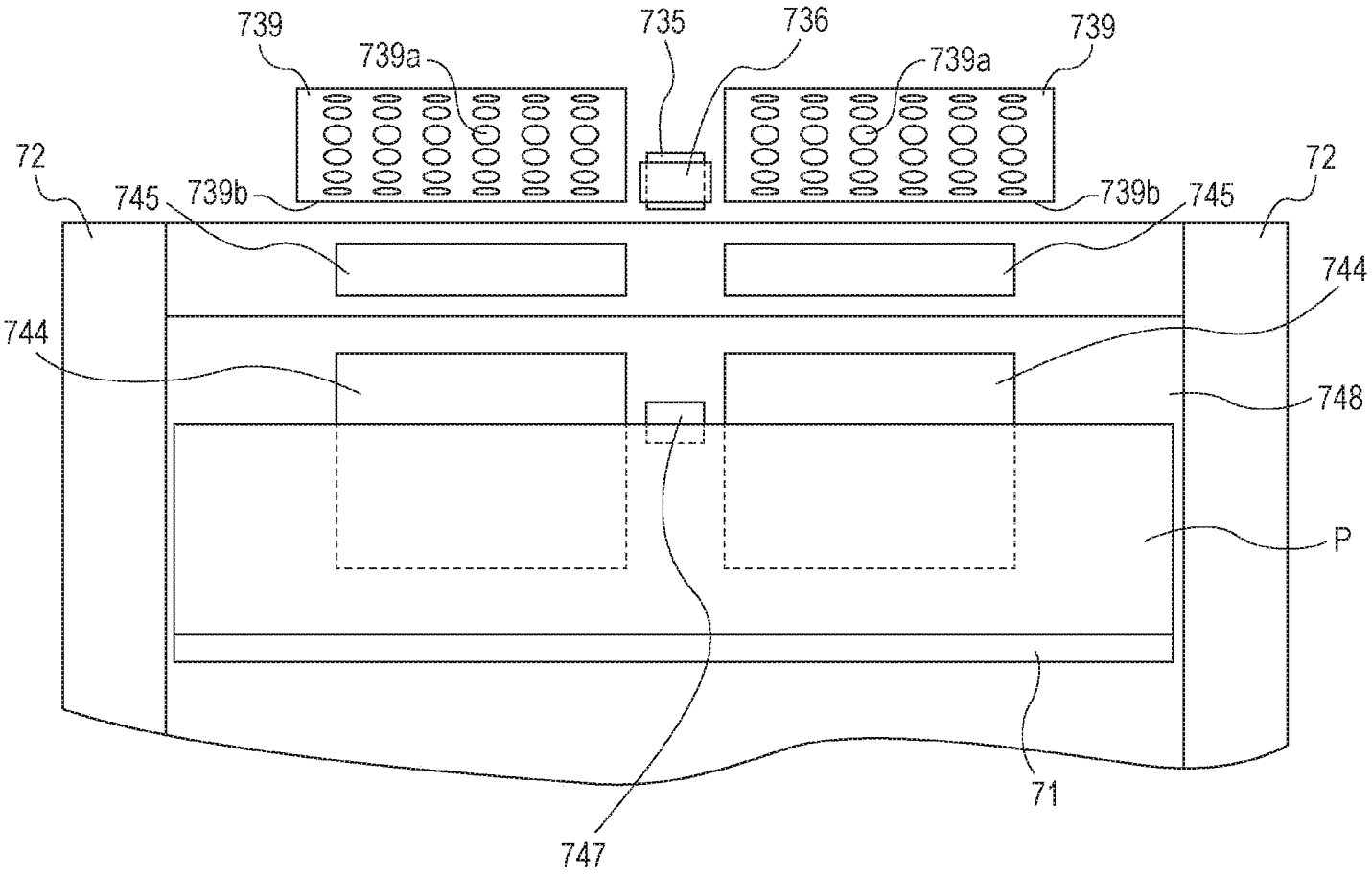
FIG. 5 is a front view of an example structure of the paper feeder according to the first embodiment of the present invention.
Figure 6:
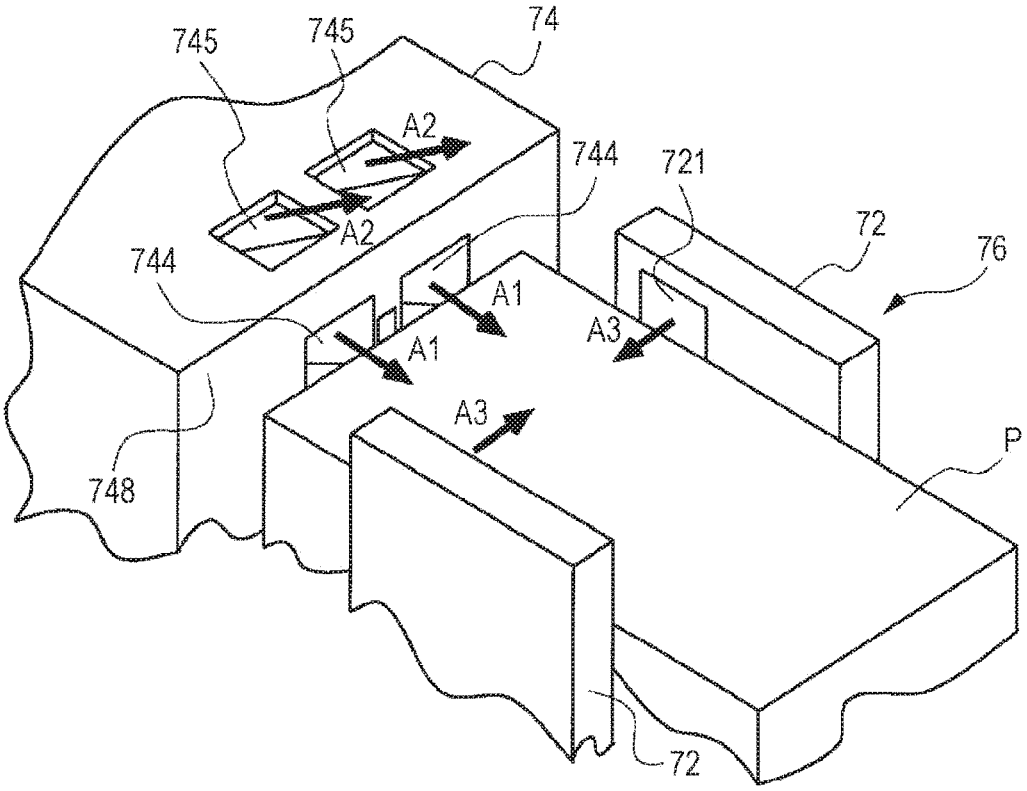
FIG. 6 is a perspective view of an example structure of a paper holder according to the first embodiment of the present invention.

FIG. 4 is a side view of an example structure of a paper feeder 70 according to the first embodiment of the present invention. FIG. 5 is a front view of an example structure of the paper feeder 70 according to the first embodiment of the present invention. FIG. 6 is a perspective view of an example structure of the paper holder 76 according to the first embodiment of the present invention.

The paper feeder 70 includes the pair of side guides 72, the drawing conveyor 73, and the air blower 74. In the paper feeder 70, the side guides 72 blow side air A3 on the paper sheets P in the width direction of the paper sheets P, and the air blower 74 blows floating air A1 on the paper sheets P for floating some paper sheets P and then blows separating air A2 on the floating paper sheets P for separating the uppermost paper sheet P from the lower paper sheets P, so that the drawing conveyor 73 can draw the uppermost paper sheet P only. The drawing conveyor 73 transports the uppermost paper sheet P into a transporting guide 754. As shown in FIG. 4, the transporting guide 754 is disposed between the downstream transporting roller 752 and the upstream drawing conveyor 73, and guides the paper sheet P from the drawing conveyor 73 to the transporting roller 752.

The paper feeder 70 will now be described in detail. The paper rest 71 can be moved up and down in the mounting direction of the paper sheets P by an elevating device (not shown). The air blower 74 includes a vertical stopper wall 748 for the head edges of the paper sheets P. The stopper wall 748 of the air blower 74 defines the position of the head edges of the paper sheets P on the paper rest 71. The paper rest 71 thus moves up and down along the stopper wall 748.

The air blower 74 includes a top surface detection sensor 747 to determine the position of the paper rest 71. The top surface detection sensor 747 is disposed at the position enabling the detection of the top surface of the paper sheets P in a range in which the drawing conveyor 73 can draw the paper sheets P near the top surface. The top surface detection sensor 747 is a photosensor having a light receiving element and a light emitting element, for example, and is used for detecting the top surface of the paper sheets P on the paper rest 71.

If the top surface detection sensor 747 does not detect the top surface of the paper sheets P on the paper rest 71 in the range in which the drawing conveyor 73 can draw the paper sheets P near the top surface, the paper rest 71 is moved up or down to the position enabling the drawing conveyor 73 to draw the paper sheets P near the top surface.

The drawing conveyor 73 includes a suction chamber 731, a suction fan 732, a driving roller 733, a driven roller 734, a contact piece 735, a suction detection sensor 736, a duct shutter 737, and a conveyor belt 739.

The suction chamber 731 is surrounded by the conveyor belt 739. The suction fan 732 is disposed on a vent hole (not shown) in the top surface of the suction chamber 731. The suction fan 732 sucks out air from the suction chamber 731 so that negative pressure is generated in the suction chamber 731. The negative pressure functions as suction air A4 for drawing some paper sheets P.

The duct shutter 737 is disposed at the entrance of the suction chamber 731. The duct shutter 737 closes the upstream area of the entrance of the suction chamber 731 in the transporting direction of a paper sheet P so that the strength of the negative pressure conforms to the size of the paper sheet P. The duct shutter 737 is open under normal conditions. The suction chamber 731 is thus not closed by the duct shutter 737 under normal conditions.

The conveyor belt 739 is an endless belt with suction ports 739*a*, which are through holes, as shown in FIG. 5. The lines of the suction ports 739*a* are arranged in parallel at regular intervals in the width direction of the conveyor belt 739. The lines of the suction ports 739*a* are formed in the direction orthogonal to the width direction of the conveyor belt 739 to extend in the entire length of the conveyor belt 739. The surface of the conveyor belt 739 facing the paper rest 71 functions as a suction surface 739*b* for drawing some paper sheets P. As shown in FIG. 5, a plurality of conveyor belts 739 are arranged in parallel.

The conveyor belt 739 is mounted on the driving roller 733 and the driven roller 734 with sufficient tension applied to the conveyor belt 739. The driving roller 733 rotates to move the conveyor belt 739. The driven roller 734 follows the movement of the conveyor belt 739 rotated by the driving roller 733.

As shown in FIG. 5, the contact piece 735 is disposed between the conveyor belts 739. The contact piece 735 is pushed upward by a paper sheet P drawn onto the suction surface 739*b*. The suction detection sensor 736, which is a photosensor having a light receiving element and a light emitting element, detects the displacement of the contact piece 735.

Each side guide 72 includes a side air outlet 721, a side shutter 722, and a side fan 723. The side air outlet 721 faces the side edges of the paper sheets P on the paper rest 71. The side shutter 722 closes the side air outlet 721. The side fan 723 supplies air like an air blower, for example. The air from the side fan 723 is supplied through the side air outlet 721 to function as side air A3. The side air A3 from the side air outlet 721 then blows on the side edges of the paper sheets P generally in parallel to the top surface of the paper sheets P, as shown in FIG. 6.

The air blower 74 includes a head fan 741, an air path 742, a head shutter 743, a floating air outlet 744, a separating air outlet 745, and a switching member 746. The head fan 741 supplies air like an air blower, for example. The air path 742 is a guide path formed between the head fan 741 and the floating air outlet 744 and between the head fan 741 and the separating air outlet 745. The air path 742 guides the air from the head fan 741 to the floating air outlet 744 or to the separating air outlet 745.

The head shutter 743 is disposed in the air path 742 and closes the air path 742. The floating air outlet 744 faces the head edges of the paper sheets P on the paper rest 71. The separating air outlet 745 faces the drawing conveyor 73. The switching member 746 rotates around a supporting rod 749 and directs the air supplied from the head fan 741 via the air path 742, to the floating air outlet 744 or to the separating air outlet 745.

In other words, the switching member 746 changes the direction of the air from the head fan 741. When the switching member 746 closes the way to the separating air outlet 745 in the air path 742, the air from the head fan 741 passes through the floating air outlet 744 to blow on the head edges of the paper sheets P as floating air A1. The floating air A1 from the floating air outlet 744 blows on the head edges of the paper sheets P generally parallel to the top surface of the paper sheets P, as shown in FIG. 6.

When the switching member 746 closes the way to the floating air outlet 744 in the air path 742, the air from the head fan 741 passes through the separating air outlet 745 to blow toward the conveyor belt 739 as separating air A2. The separating air A2 from the separating air outlet 745 blows toward the conveyor belt 739 so that the separating air A2 flows along the conveyor belt 739. That is, the separating air A2 blows toward the suction fan 732.

For example, some of the paper sheets P on the paper rest 71 are blown by the floating air A1 from the floating air outlet 744 and the side air A3 from the side air outlets 721, toward the conveyor belt 739. Near the conveyor belt 739, suction air A4 flows through the suction ports 739*a* into the suction chamber 731, where negative pressure is generated. The paper sheets P are thus drawn to the suction surface 739*b* of the conveyor belt 739. The paper sheets P drawn to the suction surface 739*b* are preferably blown by the separating air A2 from the separating air outlet 745 to be separated from each other, so that the suction surface 739*b* can draw the uppermost paper sheet P only.

In order to enable the head fan 741 to blow separating air A2 on the floating paper sheets P above the paper rest 71 through the air path 742 and the separating air outlet 745. The switching member 746 changes the direction of the air from the head fan 741 from a first direction (the direction of floating air A1 for floating some paper sheets P) to a second direction (the direction of separating air A2 toward the suction fan 732). The head shutter 743 blocks both of the airflows in the first and second directions, which are directed by the switching member 746.

The suction fan 732 applies negative pressure to the paper sheets P blown by the head fan 741. The conveyor belt 739 transports the uppermost paper sheet P drawn by the negative pressure applied by the suction fan 732. The driving roller 733 moves the conveyor belt 739 to transport the uppermost paper sheet P.

Figure 7:
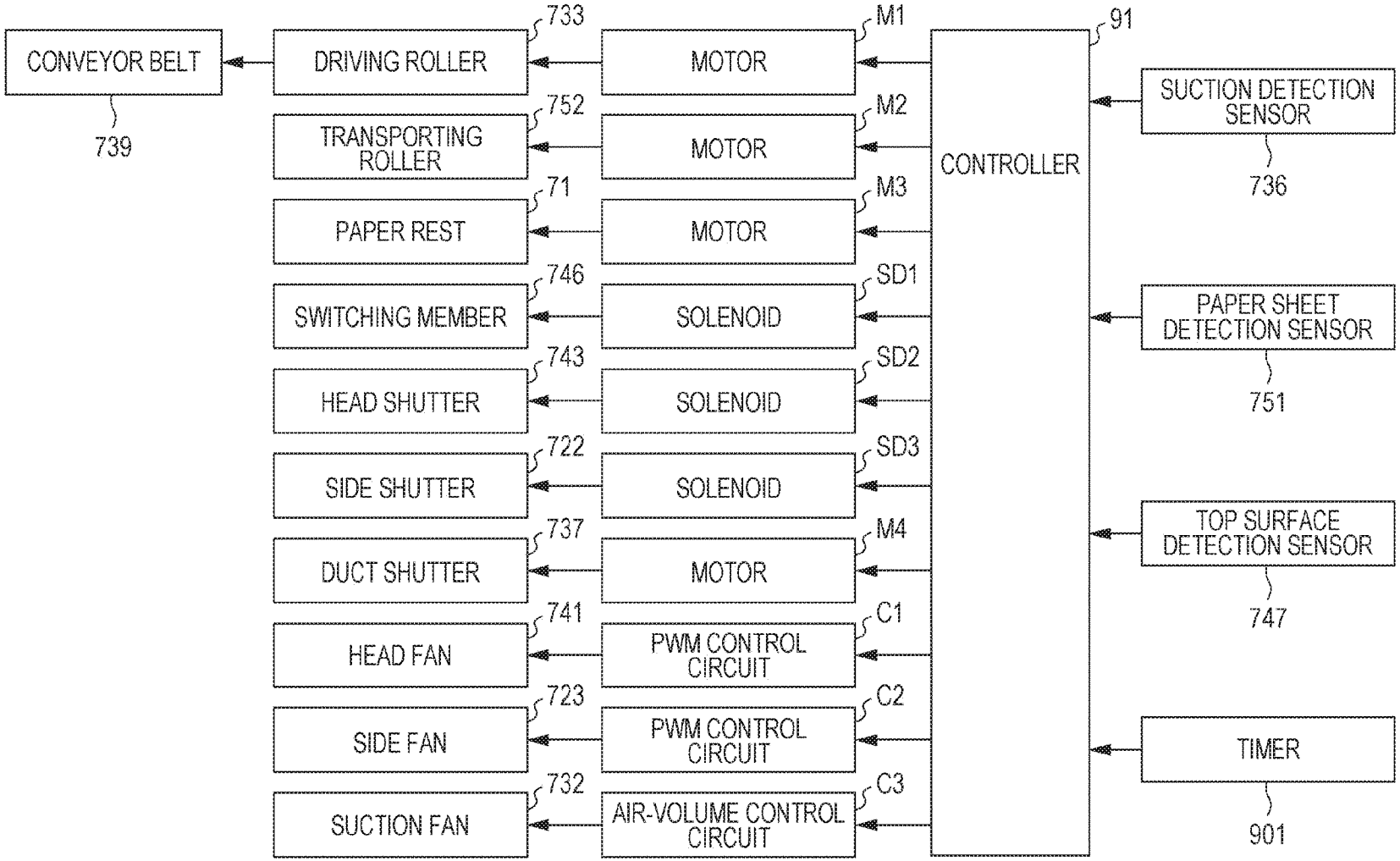
FIG. 7 is a block diagram of an example structure of the control system of the paper feeder according to the first embodiment of the present invention.

FIG. 7 is a block diagram of an example structure of the control system of the paper feeder 70 according to the first embodiment of the present invention. A controller 91 of FIG. 7 includes a CPU, a ROM, a RAM, and an I/O interface. In the controller 91, the CPU reads programs necessary for various processes from the ROM or other memory (not shown) and expands the programs in the RAM to use the programs. The controller 91 controls individual parts of the paper feeder 70 based on the programs. The controller 91 functions as a processor for performing various processes.

The controller 91 determines whether a paper sheet P is drawn onto the conveyor belt 739 or not based on the data from the suction detection sensor 736. Specifically, the suction detection sensor 736 detects displacement of the contact piece 735. When at least one paper sheet P, which is the uppermost one of the paper sheets P, is drawn onto the conveyor belt 739 by the suction fan 732, the paper sheet P comes into contact with the contact piece 735 and changes the position of the contact piece 735. The displacement of the contact piece 735 is detected by the suction detection sensor 736, which determines that the uppermost paper sheet P is drawn onto the conveyor belt 739.

When the uppermost paper sheet P is drawn onto the conveyor belt 739, the controller 91 operates a solenoid SD1 to control the switching member 746. Under the control of the controller 91, the switching member 746 changes the direction of airflow from the first direction to the second direction. When the uppermost paper sheet P is drawn onto the conveyor belt 739, the controller 91 also operates a motor M1 to rotate the driving roller 733. Under the control of the controller 91, the driving roller 733 moves the conveyor belt 739. When the uppermost paper sheet P is drawn onto the conveyor belt 739, the controller 91 also operates a solenoid SD3 to turn on (close) the side shutters 722. Under the control of the controller 91, the side shutters 722 close the side air outlets 721 to stop the supply of side air A3.

The controller 91 determines the position of the paper sheet P being transported based on the data from the paper sheet detection sensor 751. When the paper sheet detection sensor 751 detects the front end of the paper sheet P, the controller 91 operates a motor M2 to rotate the transporting roller 752. Under the control of the controller 91, the transporting roller 752 and the driven roller 753 transport the paper sheet P in the transporting unit 75.

When the paper sheet detection sensor 751 detects the back end of the paper sheet P, the controller 91 determines that the drawing conveyor 73 finishes the transportation of the paper sheet P to the transporting unit 75. After the paper sheet P has completely entered the transporting unit 75, the controller 91 starts operation for transporting the next paper sheet P to the transporting unit 75.

For example, the controller 91 operates a solenoid SD2 to turn off (open) the head shutter 743 and open the air path 742, operates the solenoid SD3 to turn off (open) the side shutters 722 and open the side air outlets 721 for side air A3, and operates the solenoid SD1 to change the position of the switching member 746. Accordingly, the switching member 746 closes the way to the separating air outlet 745 for separating air A2.

The controller 91 then uses a PWM control circuit C1 to activate the head fan 741, uses a PWM control circuit C2 to activate the side fans 723, and uses an air-volume control circuit C3 to activate the suction fan 732. The controller 91 may operate a motor M4 to control the position of the duct shutter 737 depending on the size of the paper sheets P. The controller 91 may also operate a motor M3 to move the paper rest 71 up or down based on the data from the top surface detection sensor 747 for detecting the top surface of the paper sheets P.

The controller 91 may also perform various processes based on the data from a timer 901. The data from the timer 901 is used for determining timing of activating the driving roller 733 or the transporting roller 752, for example.

Figure 8:
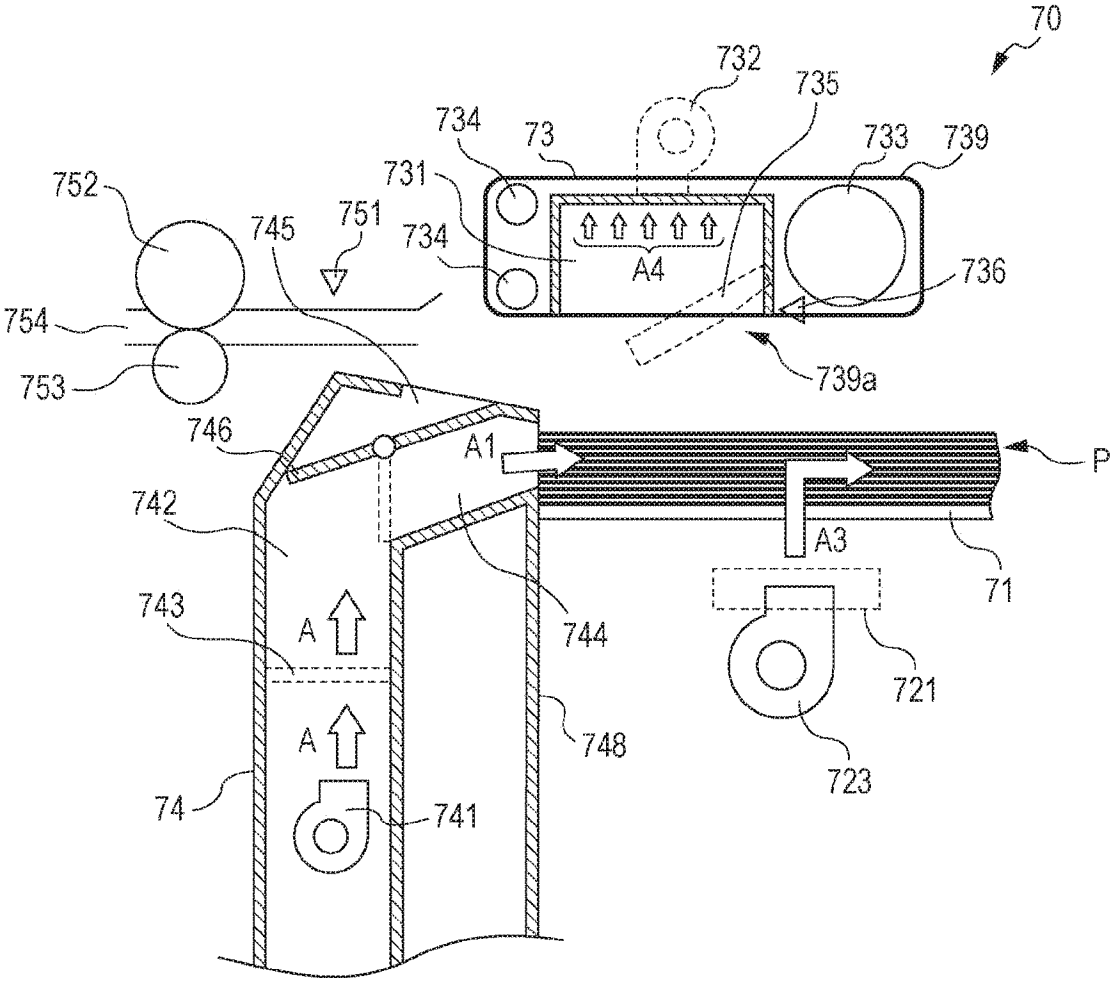
FIG. 8 is a side view showing an example state in which some paper sheets are about to be floated up in the paper feeder according to the first embodiment of the present invention.

FIG. 8 is a side view showing an example state in which some paper sheets P are about to be floated up in the paper feeder 70 according to the first embodiment of the present invention. As shown in FIG. 8, the floating air A1 from the floating air outlet 744 blows on the head edges of the paper sheets P while the side air A3 from the side air outlets 721 blows on the side edges of the paper sheets P. Since the suction fan 732 generates negative pressure in the suction chamber 731, suction air A4 flows through the suction port 739*a* into the suction chamber 731. In FIG. 8, some of the paper sheets P are about to be floated up from the paper rest 71 by the floating air A1 and the side air A3.

Figure 9:
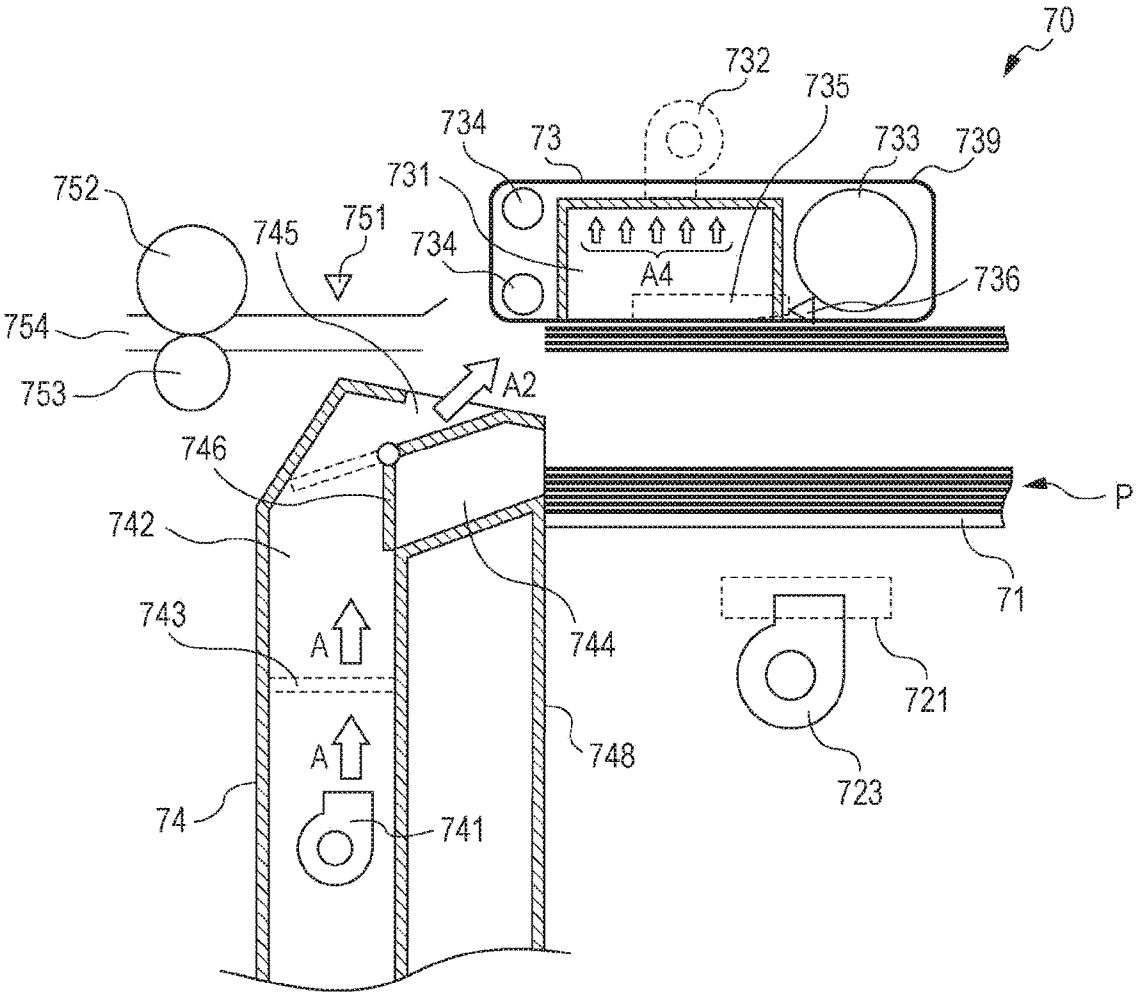
FIG. 9 is a side view showing an example state in which some paper sheets are drawn up in the paper feeder according to the first embodiment of the present invention.

FIG. 9 is a side view showing an example state in which some paper sheets P are drawn up in the paper feeder 70 according to the first embodiment of the present invention. As shown in FIG. 9, some of the paper sheets P are on the conveyor belt 739 after being floated up. The side shutters 722 are closed to block side air A3. Meanwhile, the switching member 746 changes the direction of airflow from the first direction to the second direction, and the separating air A2 from the separating air outlet 745 blows toward the conveyor belt 739. The head edges of the paper sheets P drawn onto the conveyor belt 739 are thus subjected to the separating air A2.

Figure 10:
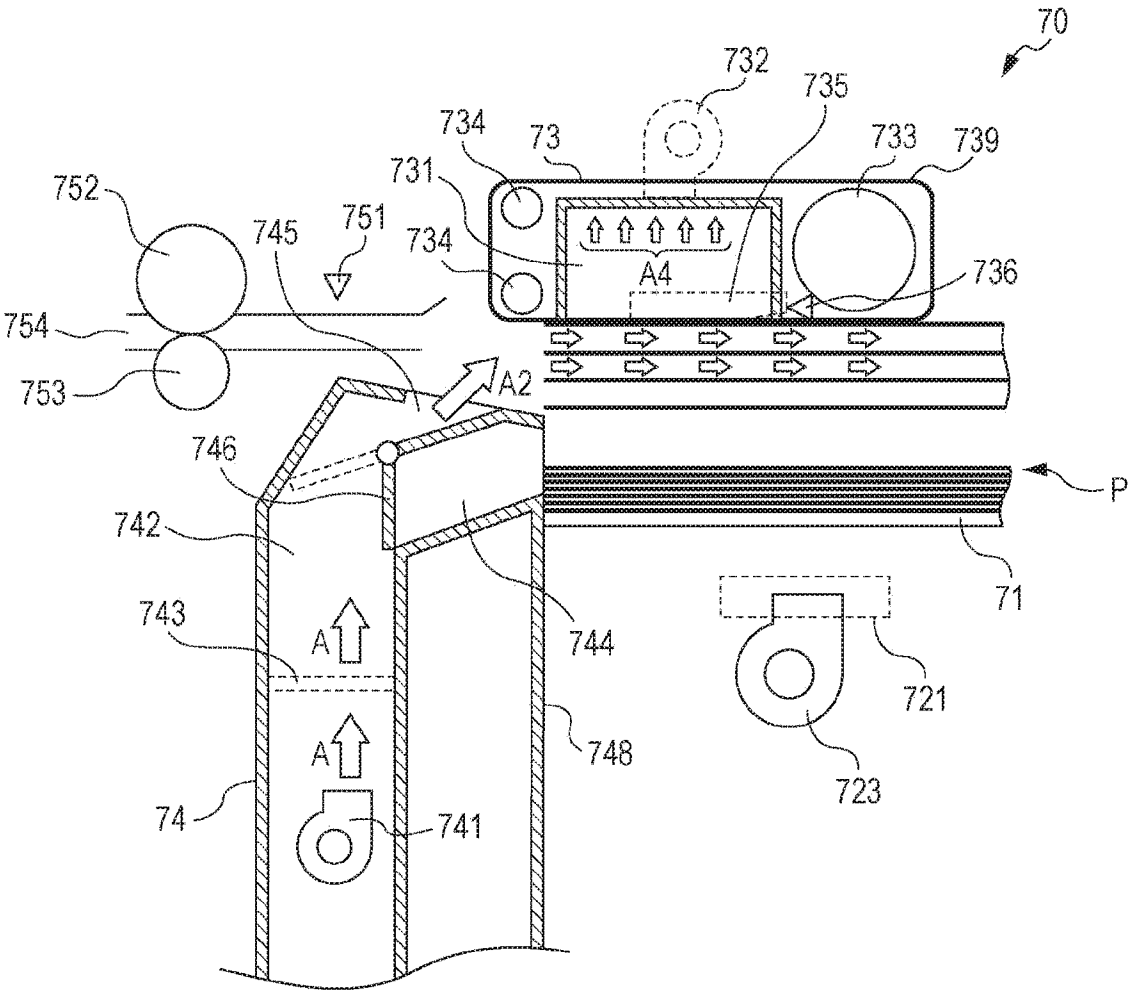
FIG. 10 is a side view showing an example state in which the floating paper sheets are being separated from each other in the paper feeder according to the first embodiment of the present invention.

FIG. 10 is a side view showing an example state in which the floating paper sheets P are being separated from each other in the paper feeder 70 according to the first embodiment of the present invention. As shown in FIG. 10, separating air A2 passes between the floating paper sheets P, which have been drawn onto the conveyor belt 739. Accordingly, the uppermost paper sheet P is separated from the lower paper sheets P. Meanwhile, the side air A3 is still being stopped.

Figure 11:
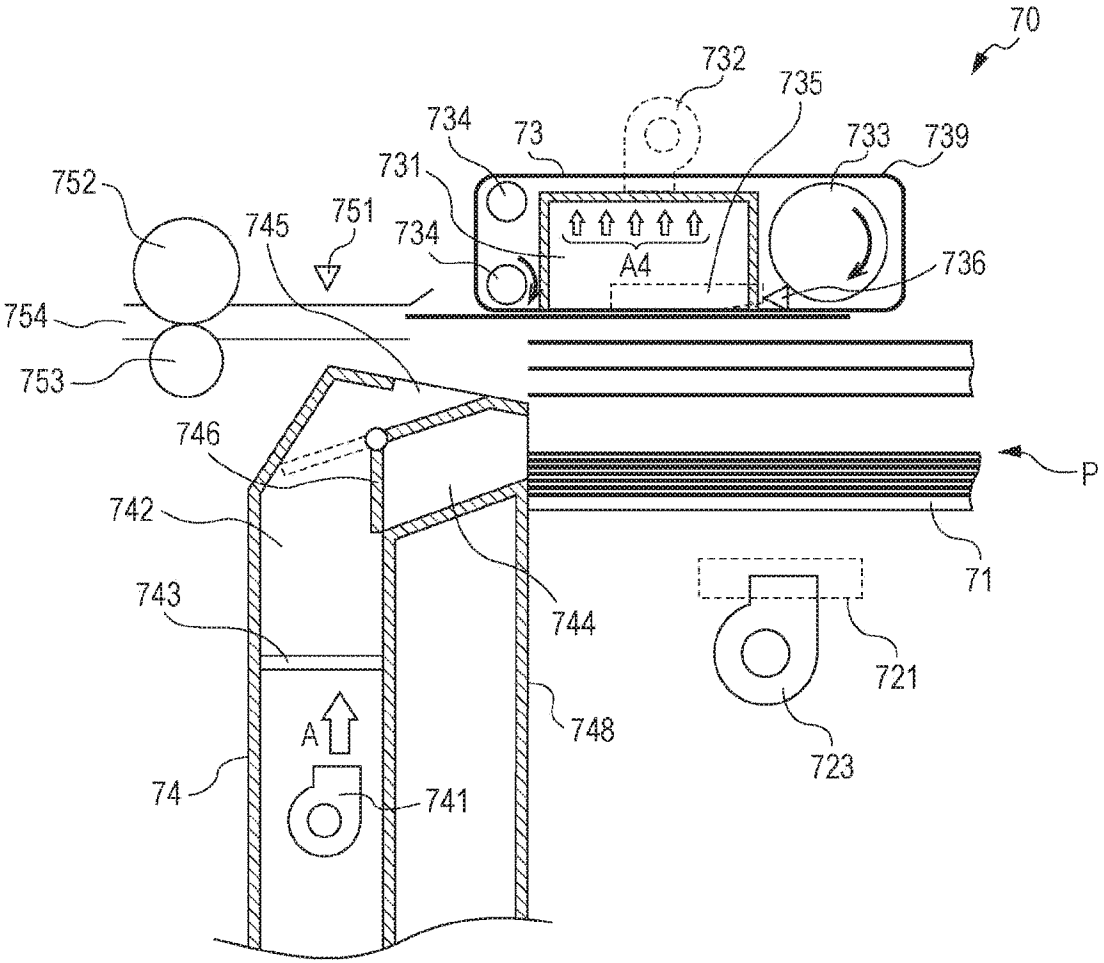
FIG. 11 is a side view showing an example state in which the uppermost paper sheet has just started to be transported in the paper feeder according to the first embodiment of the present invention.

FIG. 11 is a side view showing an example state in which the uppermost paper sheet P has just started to be transported in the paper feeder 70 according to the first embodiment of the present invention. As shown in FIG. 11, the head shutter 743 is on (closed) and no air is blowing on the paper sheets P. Under the conditions with no air, the driving roller 733 starts rotation to transport the uppermost paper sheet P to the transporting unit 75.

After FIG. 9, there is a case in which separating air A2 may fail to pass between the paper sheets P as shown in FIG.

Figure 17:
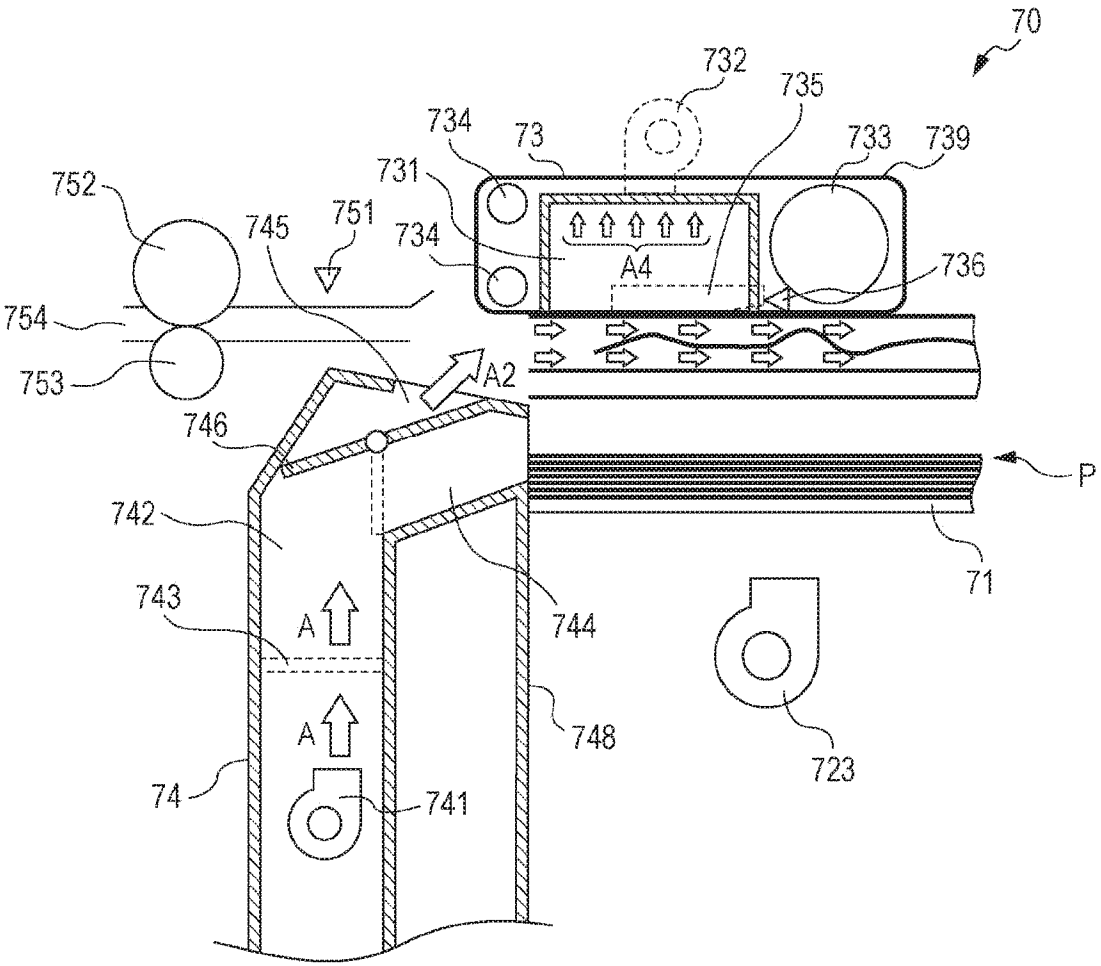
FIG. 17 is a side view showing an example state in which the uppermost thin paper sheet is about to be transported in the paper feeder under a conventional control.

10 depending on the type of the paper sheets P. FIG. 17 is a side view showing an example state in which the uppermost thin paper sheet P is about to be transported in the paper feeder 70 under a conventional control. As shown in FIG. 17, the greater length of time for blowing separating air A2 on the floating thin paper sheets P causes an excessive air supply to the thin paper sheets P. The excessive air supply may cause the floating paper sheets P under the uppermost paper sheet P to roughly undulate, which may cause buckling or backward displacement of the lower paper sheets P. In this case, the uppermost paper sheet P can hardly be separated from the lower paper sheets P.

Figure 18:
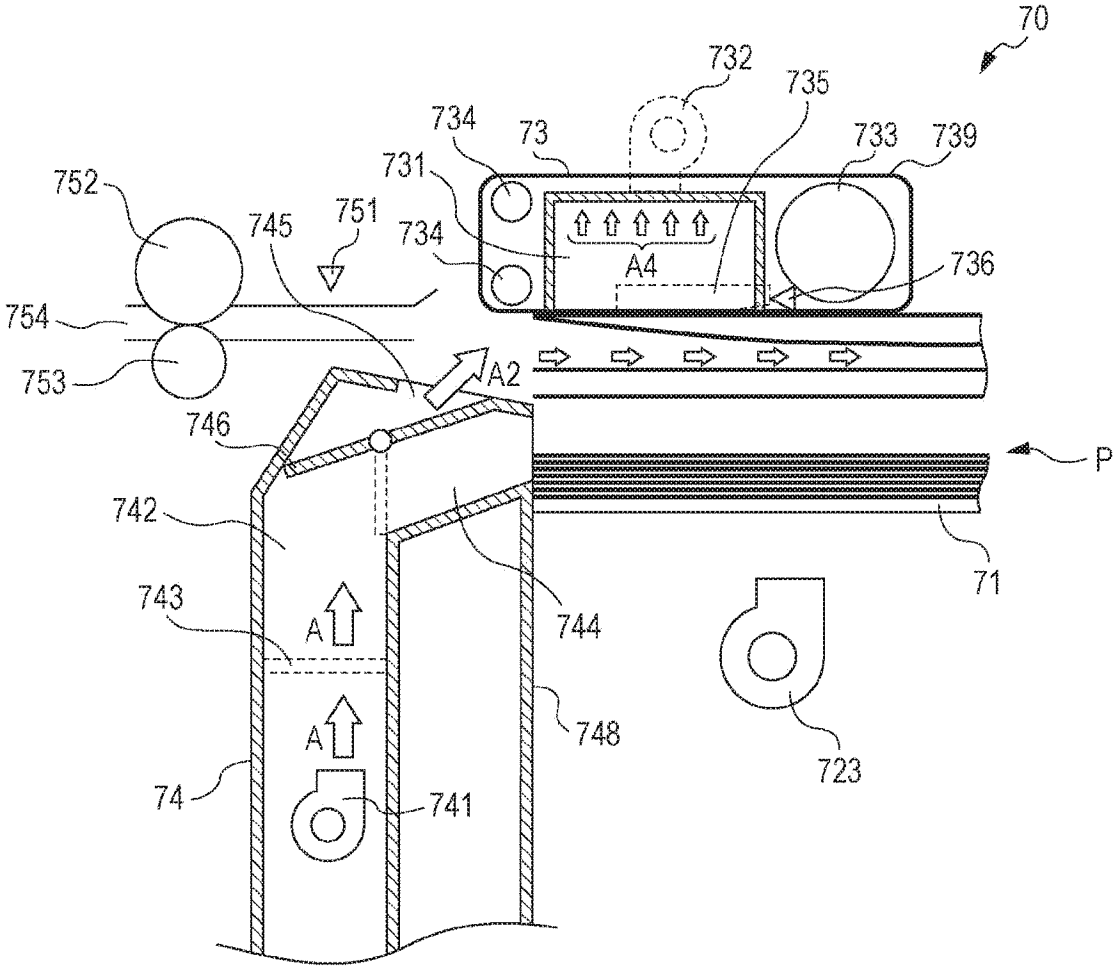
FIG. 18 is a side view showing an example state in which the uppermost thick paper sheet is about to be transported in the paper feeder under a conventional control.

FIG. 18 is a side view showing an example state in which the uppermost thick paper sheet P is about to be transported in the paper feeder 70 under a conventional control. The thick paper sheet P right under the uppermost paper sheet P hardly falls under its own weight in the position shown in FIG. 18. A part of, especially a part near the front end of the lower paper sheet P is adhering to the front end of the uppermost paper sheet P. In this case, the uppermost paper sheet P can hardly be separated from the lower paper sheets P.

To solve the above problems, the controller 91 determines the length of time for blocking airflow by the head shutter 743. Specifically, the controller 91 determines timing of stopping the air blow in the second direction directed by the switching member 746 as the start timing of clocking the length of time for blocking airflow by the head shutter 743, based on the weight of a paper sheet P and the resistance of the paper sheet P to an external force.

Based on the properly determined timing of stopping the air blow in the second direction, the driving roller 733 timely transports the uppermost paper sheet P.

More specifically, when the paper sheets P are thin, the controller 91 stops the air blow in the second direction at first timing that is a first period after the timing of changing the direction of airflow from the first direction to the second direction. The first period is determined such that the first period is shorter than the length of time causing buckling or backward displacement of the lower paper sheets, based on the length of time required for separating the uppermost paper sheet P from the lower paper sheets P.

The length of time required for separating the uppermost paper sheet P from the lower paper sheets P varies depending on the amount of curling, the direction of curling, the feed rate, the thickness, the basic weight, the stiffness, or the moisture content of the paper sheets P. The amount or direction of curling of the paper sheets P may be calculated based on the data from various sensors on the transporting path for the paper sheets P, for example. The amount of curling of the paper sheets P may be calculated based on displacement of various actuators (not shown), for example.

The feed rate of the paper sheets P may be calculated based on the data from the paper sheet detection sensor 751 for detecting a paper sheet P. When the paper sheet detection sensor 751 is a reflective photosensor, for example, the paper sheet detection sensor 751 gives different values for different feed rates of a paper sheet P. The feed rate can be calculated based on those given value.

When the paper sheets P are thick, the controller 91 stops the air blow in the second direction at second timing that is a second period before the timing of starting the transportation of the uppermost paper sheet P by the driving roller 733. The second period is determined based on the length of time required for a paper sheet P to fall under its own weight. The length of time required for a paper sheet P to fall under its own weight is determined based on the basic weight of the paper sheet P.

Specifically, in the case of a paper sheet P with a basic weight of 400 g/m$^2$, which falls under its own weight immediately, the length of time required for the paper sheet P to fall under its own weight may be 50 ms, for example. In the case of a paper sheet P with a basic weight of 100 g/m$^2$, which is affected by the negative pressure from the above and does not fall under its own weight immediately, the length of time required for the paper sheet P to fall under its own weight is preferably longer than the above length of time, 200 ms, for example.

Figure 12:
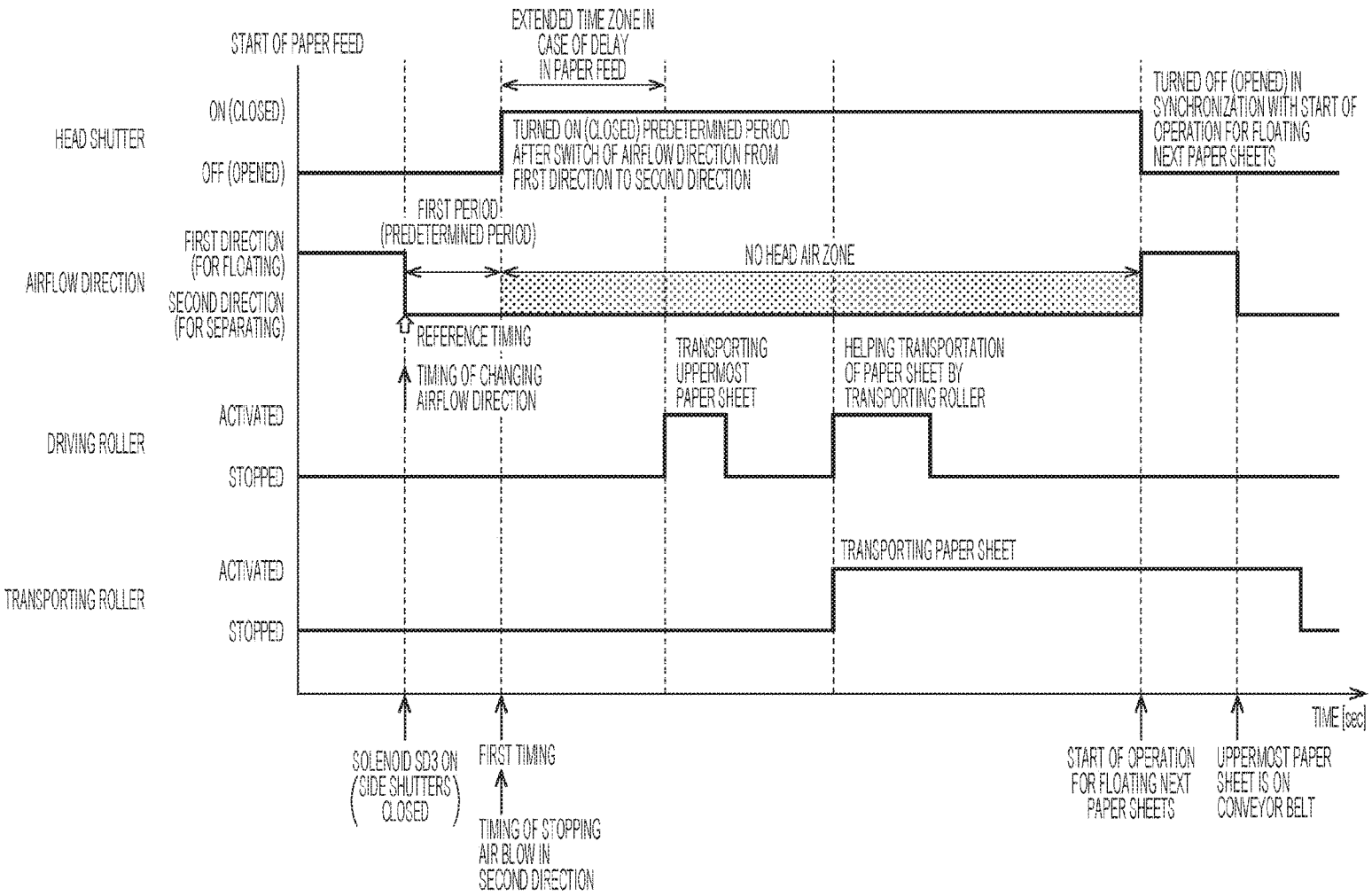
FIG. 12 is a time diagram showing an example operation of the paper feeder in a first mode according to the first embodiment of the present invention.

FIG. 12 is a time diagram showing an example operation of the paper feeder 70 in a first mode according to the first embodiment of the present invention. As shown in FIG. 12, the controller 91 stops the air blow in the second direction at the first timing that is the first period (a predetermined period) after the timing of changing the direction of airflow from the first direction to the second direction. Specifically, the controller 91 turns on (closes) the head shutter 743 so that the first timing is in synchronization with the timing of stopping the air blow in the second direction. Accordingly, the head shutter 743 is turned on (closed) the predetermined period (the first period) after the timing of the switch from floating air A1 to air A2.

Even if the activation of the driving roller 733 is postponed due to the delay in paper feed, the paper sheets P will not roughly undulate under the conditions without separating air A2. The supply of separating air A2 in the second direction is stopped until the operation for floating the next paper sheets P starts.

Figure 13:
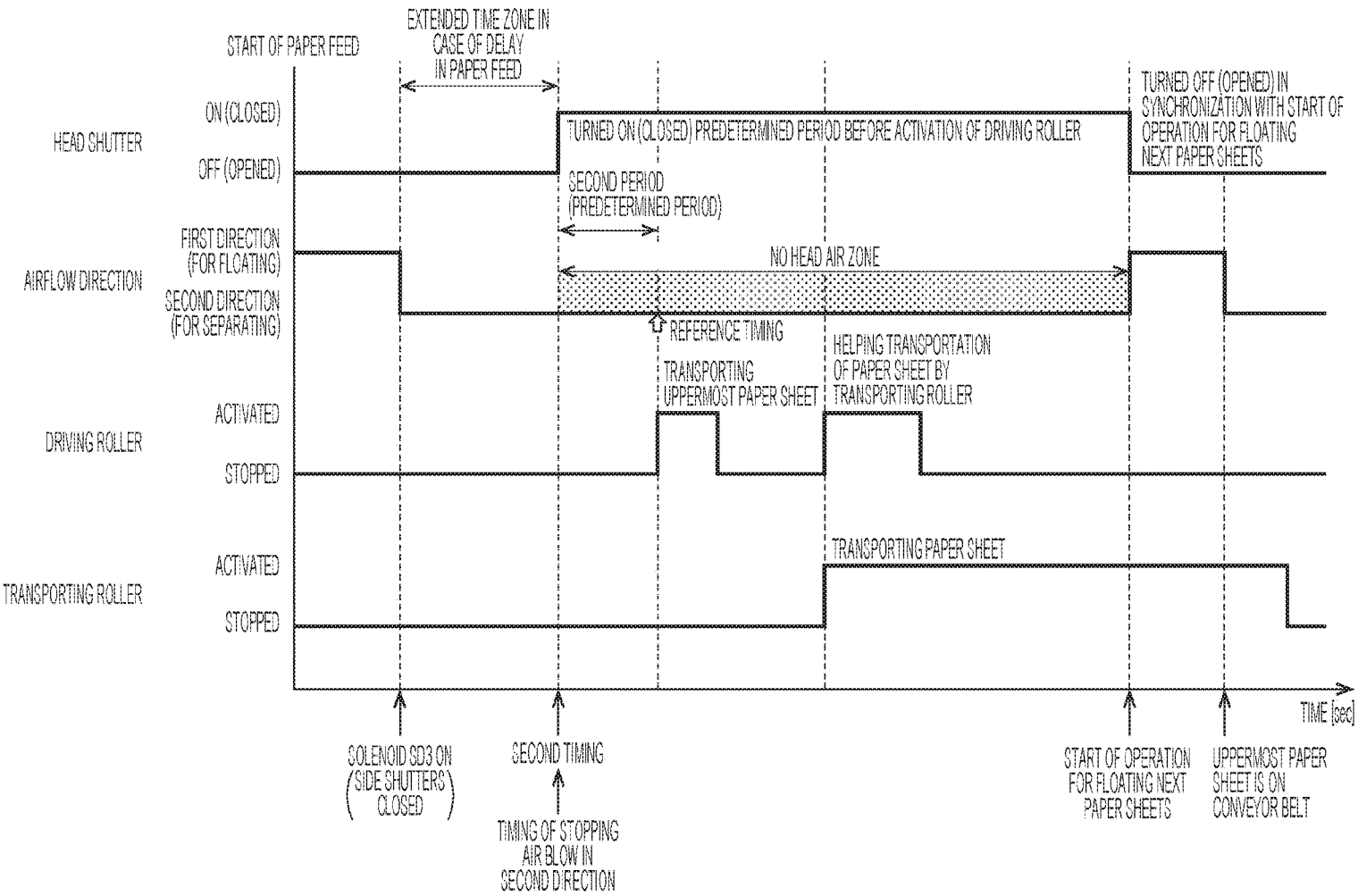
FIG. 13 is a time diagram showing an example operation of the paper feeder in a second mode according to the first embodiment of the present invention.

FIG. 13 is a time diagram showing an example operation of the paper feeder 70 in a second mode according to the first embodiment of the present invention. As shown in FIG. 13, the controller 91 stops the air blow in the second direction at the second timing that is the second period (a predetermined period) before the timing of activating the driving roller 733. Specifically, the controller 91 turns on (closes) the head shutter 743 so that the second timing is in synchronization with the timing of stopping the air blow in the second direction. Accordingly, the head shutter 743 is turned on (closed) the predetermined period (the second period) before the timing of the activation of the driving roller 733.

Even if the turn-on (closure) of the head shutter 743 is postponed due to the delay in paper feed, the transportation of the uppermost paper sheet P will not adversely effected under the conditions in which the predetermined period (the second period) is ensured as the length of time required for the lower paper sheets P to fall under their own weight between the turn-on (closure) of the head shutter 743 and the activation of the driving roller 733. The supply of separating air A2 in the second direction is stopped until the operation for floating the next paper sheets P starts.

In order to keep a certain level of productivity, the timing of activating the driving roller 733 is clocked by the timer 901 shown in FIG. 7, for example. Based on the data from the timer 901, the controller 91 determines the timing of activating the driving roller 733.

Figure 14:
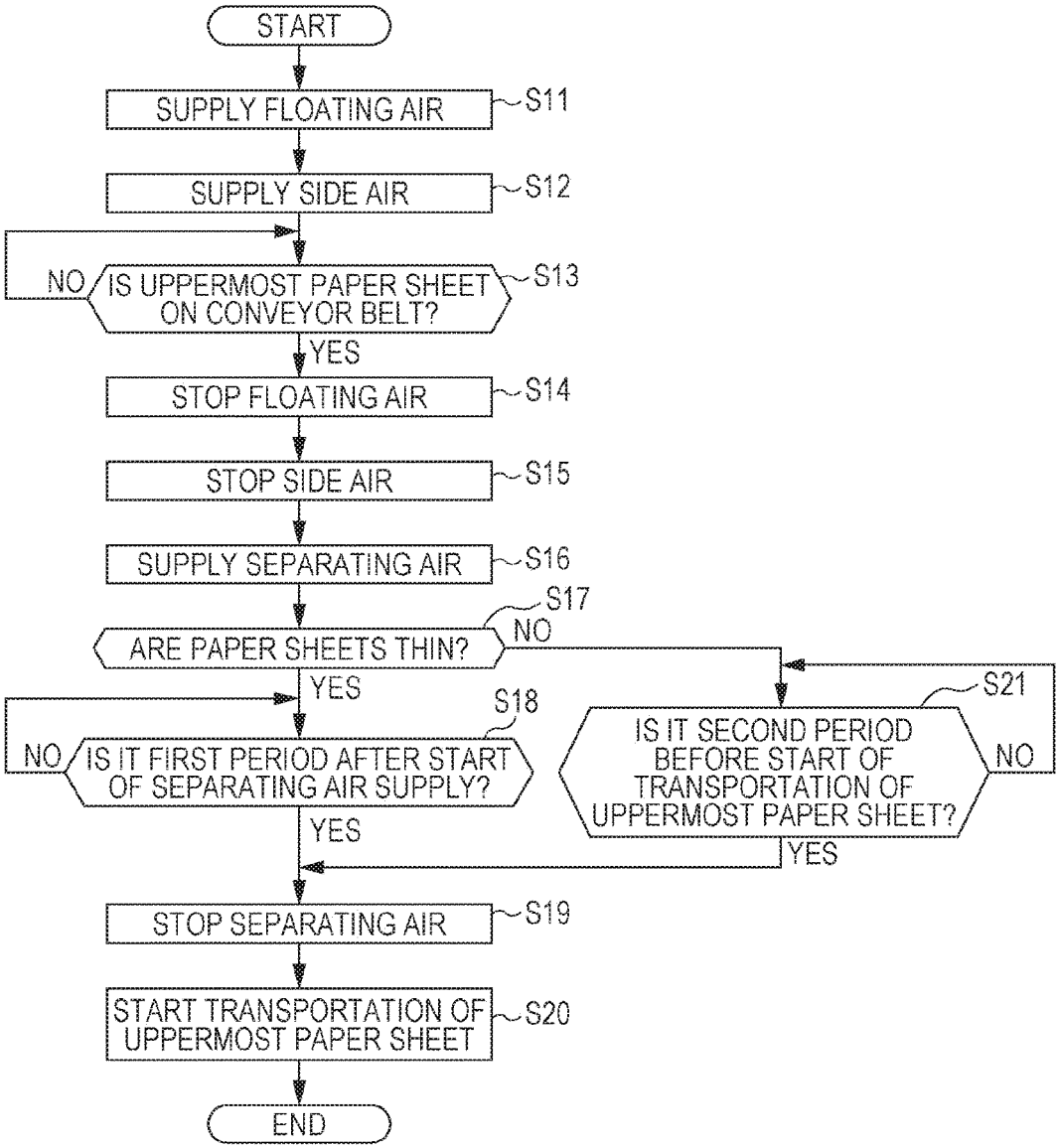
FIG. 14 is a flow chart explaining an example operation of the paper feeder according to the first embodiment of the present invention.

FIG. 14 is a flow chart explaining an example operation of the paper feeder 70 according to the first embodiment of the present invention. Steps S11 and S12 may be performed in parallel or in inverse order. Steps S14 to S16 may be performed in parallel or in a different order.

At step S11, the controller 91 starts supplying floating air A1 to the head edges of the paper sheets P for floating some paper sheets P. At step S12, the controller 91 starts supplying side air A3 to the side edges of the paper sheets P for floating some paper sheets P. At step S13, the controller 91 determines whether the uppermost paper sheet P is in the drawn state or not. If the uppermost paper sheet P is determined to be in the drawn state, the controller 91 performs step S14. If the uppermost paper sheet P is determined not to be in the drawn state, the controller 91 repeats step S13.

At step S14, the controller 91 stops supplying the floating air A1. At step S15, the controller 91 stops supplying the side air A3. At step S16, the controller 91 starts supplying separating air A2 to the floating paper sheets P for separating the uppermost paper sheet P from the lower paper sheets P.

At step S17, the controller 91 determines whether the paper sheets P are thin or not. If the paper sheets P are determined to be thin, the controller 91 performs step S18. If the paper sheets P are determined not to be thin, the controller 91 performs step S21.

At step S18, the controller 91 determines whether it is the first period after the start of the supply of separating air A2 or not. If it is determined to be the first period after the start of the supply of separating air A2, the controller 91 performs step S19. If it is determined not to be the first period after the start of the supply of separating air A2, the controller 91 repeats step S18.

At step S19, the controller 91 stops supplying the separating air A2. At step S20, the controller 91 starts transporting the uppermost paper sheet P and ends the procedures.

At step S21, the controller 91 determines whether it is the second period before the start of the transportation of the uppermost paper sheet P or not. If it is determined to be the second period before the start of the transportation of the uppermost paper sheet P, the controller 91 performs step S19. If it is determined not to be the second period before the start of the transportation of the uppermost paper sheet P, the controller 91 repeats step S21.

Figure 15:
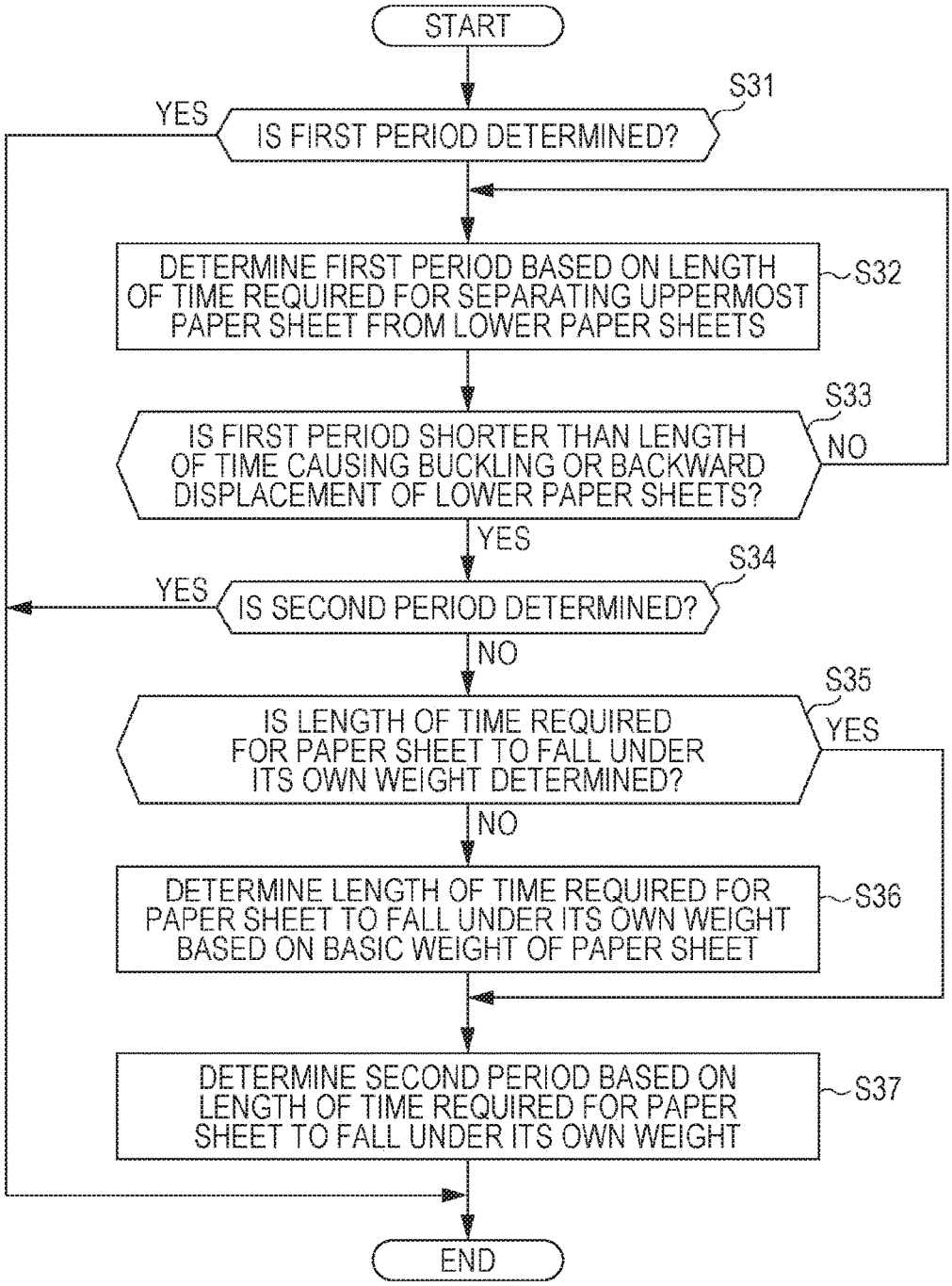
FIG. 15 is a flow chart explaining an example operation of the paper feeder for determining various parameters according to the first embodiment of the present invention.

FIG. 15 is a flow chart explaining an example operation of the paper feeder 70 for determining various parameters according to the first embodiment of the present invention.

At step S31, the controller 91 determines whether the first period is determined or not. If the first period is determined to be determined, the controller 91 ends the procedures. If the first period is determined not to be determined, the controller 91 performs step S32.

At step S32, the controller 91 determines the first period based on the length of time required for separating the uppermost paper sheet P from the lower paper sheets P.

At step S33, the controller 91 determines whether the first period is shorter than the length of time causing buckling or backward displacement of the lower paper sheets P. If the first period is determined to be shorter than the length of time causing buckling or backward displacement of the lower paper sheets P, the controller 91 performs step S34. If the first period is determined not to be shorter than the length of time causing buckling or backward displacement of the lower paper sheets P, the controller 91 performs step S32 again.

At step S34, the controller 91 determines whether the second period is determined or not. If the second period is determined to be determined, the controller 91 ends the procedures. If the second period is determined not to be determined, the controller 91 performs step S35. At step S35, the controller 91 determines whether the length of time required for a paper sheet P to fall under its own weight is determined or not. If the length of time required for a paper sheet P to fall under its own weight is determined to be determined, the controller 91 performs step S37. If the length of time required for a paper sheet P to fall under its own weight is determined not to be determined, the controller 91 performs step S36.

At step S36, the controller 91 determines the length of time required for a paper sheet P to fall under its own weight based on the basic weight of the paper sheet P. At step S37, the controller 91 determines the second period based on the length of time required for a paper sheet P to fall under its own weight and ends the procedures.

As described above, according to this embodiment, the paper feeder 70 determines the timing of stopping the air blow in the second direction based on the weight of a paper sheet P and the resistance of the paper sheet P to an external force, which enables the control of the length of time for blowing the floating paper sheets P depending on the type of the paper sheets P. Accordingly, the paper feeder 70 can supply an appropriate (neither too small nor too large) volume of air for separating the uppermost paper sheet P from the lower paper sheets P under the simple control of the timing of stopping the air blow in the second direction, which achieves appropriate conditions for various types of paper sheets P with a low-cost structure for controlling the volume of air.

According to this embodiment, the paper feeder 70 starts the transportation of the uppermost paper sheet P based on the timing of stopping the air blow in the second direction, which enables appropriate air supply for separating the uppermost paper sheet P from the lower paper sheets P as well as timely transportation of the uppermost paper sheet P. This prevents the lower paper sheets P from being transported together with the uppermost paper sheet P.

According to this embodiment, the paper feeder 70 changes the direction of airflow to the direction toward the suction fan 732 while the uppermost paper sheet P is in the drawn state, which enables timely separation of the uppermost paper sheet P from the lower paper sheets P. The number of the lower paper sheets P may be one or more.

According to this embodiment, when the paper sheets P are thin, the paper feeder 70 stops the air blow in the second direction based on the timing of changing the direction of airflow from the direction for floating some paper sheets P to the direction toward the suction fan 732, which ensures an appropriate length of time for separating the uppermost paper sheet P from the lower paper sheets P.

According to this embodiment, when the paper sheets P are thin, the paper feeder 70 determines the first period between the timing of changing the direction of airflow and the timing of stopping the air blow in the second direction such that the first period is shorter than the length of time causing buckling or backward displacement of the lower paper sheets P, based on the length of time required for separating the uppermost paper sheet P from the lower paper sheets P. When the transportation of the uppermost paper sheet P is postponed, the length of time with no air blowing on the floating paper sheets P is extended, which prevents a paper jam caused by buckling and backward displacement of the lower paper sheets P.

According to this embodiment, when the paper sheets P are thick, the paper feeder 70 stops the air blow in the second direction based on the timing of starting the transportation of the uppermost paper sheets P. Accordingly, when the transportation of the uppermost paper sheet P is postponed, the length of time for separating the uppermost paper sheet P from the lower paper sheets P is extended. When the paper sheets P are thick, the longer air supply to the head edges of the floating paper sheets P causes no buckling or backward displacement of the lower paper sheets P. The longer air supply to the floating paper sheets P rather enhances the function for separating the uppermost paper sheet P from the lower paper sheets P. Accordingly, the lower the paper sheets P are not transported together with the uppermost paper sheet P.

According to this embodiment, when the paper sheets P are thick, the paper feeder 70 determines the second period between the timing of starting the transportation of the uppermost paper sheet P and the timing of stopping the air blow in the second direction based on the length of time required for a paper sheet P to fall under its own weight. Accordingly, a sufficient length of time for the lower paper sheets P to fall under their weight is ensured, which prevents the lower the paper sheets P from being transported together with the uppermost paper sheet P.

According to this embodiment, the paper feeder 70 determines the length of time required for a paper sheet P to fall under its own weight based on the basic weight of the paper sheet P. Since the length of time required for a paper sheet P to fall under its own weight is determined based on the easiness for the paper sheet P to fall under its own weight, the paper feeder 70 stops the air blow in the second direction at intervals appropriate for the type of the paper sheets P.

According to this embodiment, the length of time required for separating the upper paper sheet P from the lower paper sheet P varies depending on the amount of curling, the direction of curling, the feed rate, the thickness, the basic weight, the stiffness, or the moisture content of the paper sheets P. Accordingly, the paper feeder 70 stops the air blow in the second direction based on the conditions of the paper sheets P.

Second Embodiment

A second embodiment will now be described with the same reference numerals for the structural elements that are the same as those in the first embodiment. The explanation about the same structural elements will be omitted. Different from the first embodiment, the second embodiment includes some additional processes for determining some conditions of the paper sheets P to the processes for determining whether separating air A2 is stopped or not.

When the paper sheets P are in intimate contact with each other and hardly fall under their own weight, the controller 91 extends the first period. When the first period is extended, the switching member 746 directs airflow in the second direction at the beginning of the transportation of the uppermost paper sheet P by the driving roller 733.

When the paper sheets P are coated paper sheets, the paper sheets P tend to be in intimate contact with each other. Even if the paper sheets P are coated paper sheets, however, some types of the paper sheets P can fall under their own weight depending on their thickness. When the paper sheets P are thick coated paper sheets, the paper feeder 70 may perform the procedures for thick paper sheets. When the paper sheets P are thin coated paper sheets, the paper feeder 70 may perform the procedures for thin paper sheets.

When the paper sheets P are coated paper sheets with a normal thickness, it is difficult to determine whether the paper sheets P can fall under their own weight or not. In this case, the paper feeder 70 preferably blows separating air A2 to the head edges of the paper sheets P.

Figure 16:
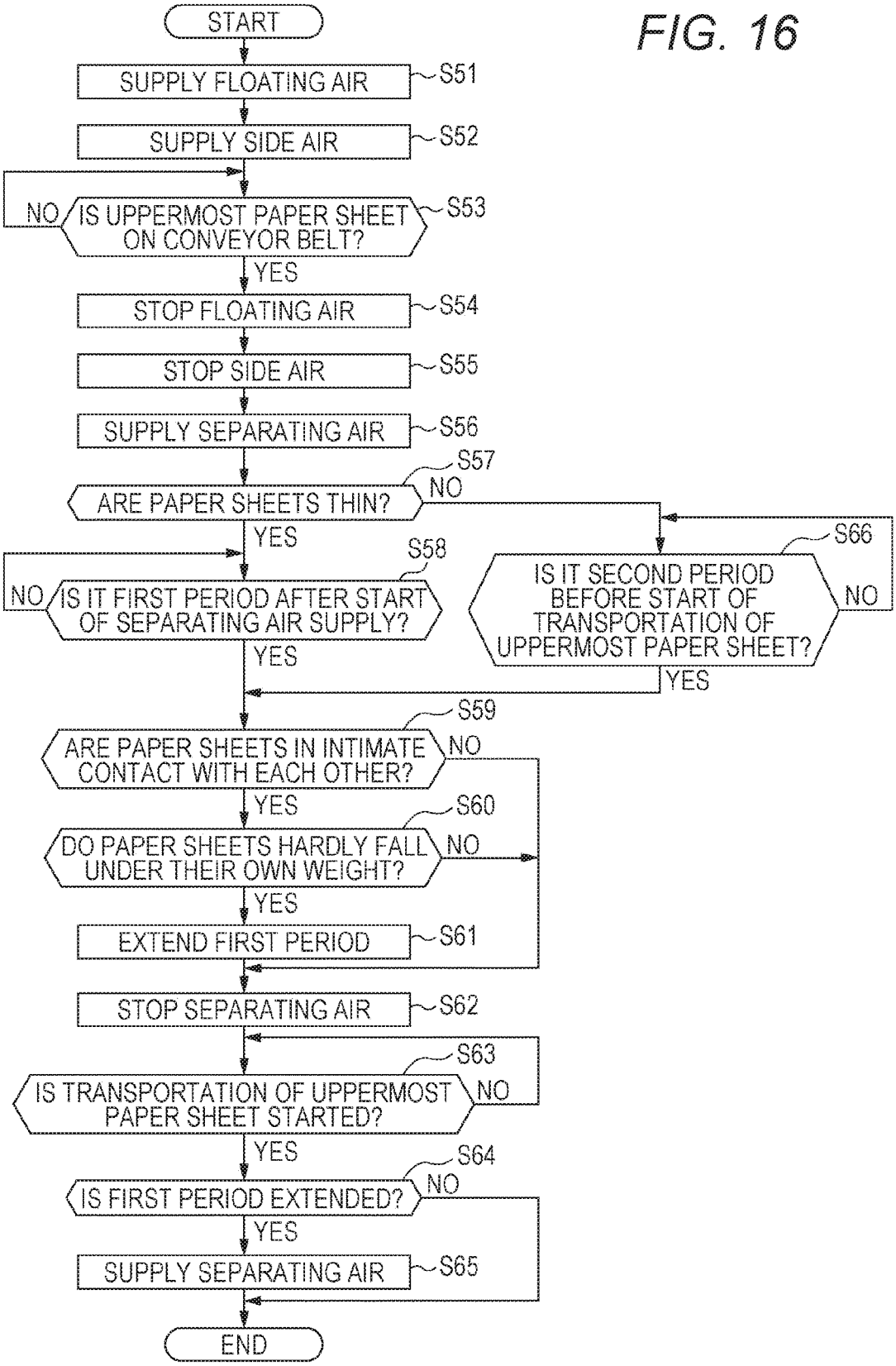
FIG. 16 is a flow chart explaining an example operation of the paper feeder according to a second embodiment of the present invention.

FIG. 16 is a flow chart explaining an example operation of the paper feeder 70 according to the second embodiment of the present invention. Steps S51 to S58 and step S66 are the same as steps S11 to S18 and step S21, respectively. The explanation about steps S51 to S58 and step S66 will thus be omitted. Step S62 may be skipped. When step S62 is skipped, the length of time for separating the uppermost paper sheet P from the lower paper sheets P by separating air A2 can be maximized. When step S62 is skipped, step S65 for starting the supply of separating air A2 is preferably changed to a step for continuing the supply of separating air A2.

At step S59, the controller 91 determines whether the paper sheets P are in intimate contact with each other or not. If the paper sheets P are determined to be in intimate contact with each other, the controller 91 performs step S60. If the paper sheets P are determined not to be in intimate contact with each other, the controller 91 performs step S62.

At step S60, the controller 91 determines whether the paper sheets P hardly fall under their own weight or not. If it is determined that the paper sheets P hardly fall under their own weight, the controller 91 performs step S61. If it is determined that the paper sheets P can fall under their own weight, the controller 91 performs step S62.

At step S61, the controller 91 extends the first period. In other words, the controller 91 extends the length of time for blowing separating air A2 on the head edges of the floating paper sheets P.

At step S62, the controller 91 stops supplying separating air A2. At step S63, the controller 91 determines whether the transportation of the uppermost paper sheet P is started or not. If it is determined that the transportation of the uppermost paper sheet P is started, the controller 91 performs step S64. If it is determined that the transportation of the uppermost paper sheet P is not started, the controller 91 repeats step S63.

At step S64, the controller 91 determines whether the first period is extended or not. If it is determined that the first period is extended, the controller 91 performs step S65. If it is determined that the first period is not extended, the controller 91 ends the procedures.

At step S65, the controller 91 starts supplying separating air A2 and ends the procedures.

As described above, according to this embodiment, when the paper sheets P are in intimate contact with each other and hardly fall under their own weight, the paper feeder 70 extends the first period between the timing of changing the direction of airflow and the timing of stopping the air blow in the second direction. Accordingly, the paper feeder 70 ensures a sufficient length of time for separating the uppermost paper sheet P from the lower paper sheets P, which are coated sheets, for example, and hardly separate from the uppermost paper sheet P.

According to this embodiment, when the first period is extended under the conditions that the paper sheets P are in intimate contact with each other and hardly fall under their own weight, the paper feeder 70 blows air toward the suction fan 732 at the beginning of the transportation of the uppermost paper sheet P. Accordingly, the paper feeder 70 ensures a sufficient length of time for separating the uppermost paper sheet P from the lower paper sheets P, which are coated paper sheets, for example, and hardly fall under their own weight, at the time of the transportation of the upper paper sheet P.

Although the image forming system 1 of the present invention have been described based on the above embodiments, the present invention is not limited to these embodiments and may be modified within the scope of the invention.

For example, in the above embodiments, the image forming system 1 includes the paper feeding apparatus 2 and the image forming apparatus 3, however, the embodiments are not limited to this. Alternatively, the image forming system 1 may include an image reading apparatus, an intermediate apparatus, and a post-processing apparatus.

In the above embodiments, the length of time required for separating the upper paper sheet P from the lower paper sheets varies depending on the amount of curling, the direction of curling, the feed rate, the thickness, the basic weight, the stiffness, or the moisture content of the paper sheets P, however, the embodiments are not limited to this. Alternatively, the length of time required for separating the uppermost paper sheets P from the lower paper sheets P may vary depending on the temperature and humidity conditions, or the behaviors of the paper sheets P. The temperature and humidity conditions may be detected by temperature and humidity sensors (not shown) in the paper compartments P11. The behaviors of the paper sheets P may be detected by various sensors (not shown) in the paper compartments P11. These sensors may be CMOS sensors, CCD sensors, or other photosensors, for example.

In the above embodiments, the sensors are photosensors, however, the embodiments are not limited to this. Alternatively, the sensors may be photointerrupters, for example.

In the embodiments of the present invention, some of the procedures in the first embodiment may be combined with some of the procedures in the second embodiment.

Although embodiments of the present invention have been described and illustrated in detail, it is clearly understood that the same is by way of illustration and example only and not limitation, the scope of the present invention should be interpreted by terms of the appended claims.

What is claimed is:

1. A paper feeder for transporting paper sheets from a paper rest, comprising:

a head fan that blows air through an air path toward the paper sheets on or above the paper rest;

a suction fan that applies negative pressure to some of the paper sheets blown by the head fan;

a switching member disposed in the air path that changes a direction of the air from the head fan;

a head shutter disposed in the air path between the head fan and the switching member, wherein the head shutter selectively stops a flow of the air through the air path directed to the switching member; and a hardware processor that determines a length of time for blocking the airflow by the head shutter, wherein the switching member is configured to switch between a first position in which air from the head fan is directed in a first direction for floating some of the paper sheets and a second position in which air from the head fan is directed in a second direction toward the suction fan, and the hardware processor controls the head shutter to stop air flow of the air directed by the switching member at a stop time when the switching member is in the second position, the hardware processor determines the stop time based on a weight of one of the paper sheets and a resistance of the one of the paper sheets to an external force, the stop time being a start time for the length of time for blocking the airflow by the head shutter.

2. The paper feeder according to claim 1, further comprising:

a conveyor belt that transports an uppermost paper sheet of the paper sheets drawn by the negative pressure applied by the suction fan; and a driving roller that moves the conveyor belt to transport the uppermost paper sheet based on the stop time.

3. The paper feeder according to claim 2, wherein the switching member changes the direction of the airflow from the first direction to the second direction when the uppermost paper sheet is determined to be in a drawn state by the suction fan.

4. The paper feeder according to claim 3, wherein the hardware processor determines the stop time to be at a first timing that is a first period after predetermined timing of changing the direction of the airflow from the first direction to the second direction when the paper sheets have a first thickness.

5. The paper feeder according to claim 4, wherein the hardware processor determines the first period such that the first period is shorter than a length of time causing buckling or backward displacement of lower paper sheets, based on a length of time required for separating the uppermost paper sheet from the lower paper sheets.

6. The paper feeder according to claim 5, wherein the hardware processor determines the stop time to be at a second timing that is a second period before predetermined timing of starting the transportation of the uppermost paper sheet by the driving roller when the paper sheets have a second thickness greater than the first thickness.

7. The paper feeder according to claim 6, wherein the hardware processor determines the second period based on a length of time required for one of the paper sheets to fall under its own weight.

8. The paper feeder according to claim 7, wherein the hardware processor determines the length of time required for one of the paper sheets to fall under its own weight based on a basic weight of the one of the paper sheets.

9. The paper feeder according to claim 8, wherein the hardware processor extends the first period when the paper sheets are in intimate contact with each other and hardly fall under their own weight.

10. The paper feeder according to claim 9, wherein the switching member directs the airflow in the second direction at the beginning of the transportation of the uppermost paper sheet by the driving roller when the first period is extended.

11. The paper feeder according to claim 5, wherein the length of time required for separating the uppermost paper sheet from the lower paper sheets varies depending on an amount of curling, a direction of curling, a feed rate, the thickness, a basic weight, a stiffness, or a moisture content of the paper sheets.

12. The paper feeder according to claim 1, wherein the head shutter closes the air path to stop the flow of the air through the air path directed to the switching member.

13. A paper feeder for transporting paper sheets from a paper rest, comprising:

a head fan that blows air on the paper sheets on or above the paper rest;

a suction fan that applies negative pressure to some of the paper sheets blown by the head fan;

a switching member that changes a direction of the air from the head fan;

a head shutter that blocks a flow of the air directed by the switching member;

a hardware processor that determines a length of time for blocking the airflow by the head shutter, wherein the switching member is configured to switch between a first position in which air from the head fan is directed in a first direction for floating some of the paper sheets and a second position in which air from the head fan is directed in a second direction toward the suction fan, and the hardware processor controls the head shutter to block air flow of the air directed by the switching member at a stop time when the switching member is in the second position, the hardware processor determines the stop time based on a weight of one of the paper sheets and a resistance of the one of the paper sheets to an external force, the stop time being a start time for the length of time for blocking the airflow by the head shutter;

a conveyor belt that transports an uppermost paper sheet of the paper sheets drawn by the negative pressure applied by the suction fan; and a driving roller that moves the conveyor belt to transport the uppermost paper sheet based on the stop time, wherein the switching member changes the direction of the airflow from the first direction to the second direction when the uppermost paper sheet is determined to be in a drawn state by the suction fan, the hardware processor determines the stop time to be at a first timing that is a first period after predetermined timing of changing the direction of the airflow from the first direction to the second direction when the paper sheets have a first thickness, and the hardware processor determines the stop time to be at a second timing that is a second period before predetermined timing of starting the transportation of the uppermost paper sheet by the driving roller when the paper sheets have a second thickness greater than the first thickness.

14. The paper feeder according to claim 13, wherein the hardware processor determines the first period such that the first period is shorter than a length of time causing buckling or backward displacement of lower paper sheets, based on a length of time required for separating the uppermost paper sheet from the lower paper sheets.

15. The paper feeder according to claim 13, wherein the hardware processor determines the second period based on a length of time required for one of the paper sheets to fall under its own weight.

16. The paper feeder according to claim 15, wherein the hardware processor determines a length of time required for one of the paper sheets to fall under its own weight based on a basic weight of the one of the paper sheets.

17. The paper feeder according to claim 16, wherein the hardware processor extends the first period when the paper sheets are in intimate contact with each other and hardly fall under their own weight.

18. The paper feeder according to claim 17, wherein the switching member directs the airflow in the second direction at the beginning of the transportation of the uppermost paper sheet by the driving roller when the first period is extended.

19. The paper feeder according to claim 14, wherein the length of time required for separating the uppermost paper sheet from the lower paper sheets varies depending on an amount of curling, a direction of curling, a feed rate, the thickness, a basic weight, a stiffness, or a moisture content of the paper sheets.

* * * * *